US012544627B2

(12) United States Patent
Bretscher et al.

(10) Patent No.: US 12,544,627 B2
(45) Date of Patent: Feb. 10, 2026

(54) DEVICE FOR LEARNING AND TRAINING THE UNDERWATER DOLPHIN KICK AND METHODS

(71) Applicant: PRIMIS, LLC, Kingston, TN (US)

(72) Inventors: James Bretscher, Kingston, TN (US); Nathan Bretscher, Kingston, TN (US)

(73) Assignee: PRIMIS, LLC, Kingston, TN (US)

( * ) Notice: Subject to any disclaimer, the term of this patent is extended or adjusted under 35 U.S.C. 154(b) by 1024 days.

(21) Appl. No.: 17/592,900

(22) Filed: Feb. 4, 2022

(65) Prior Publication Data

US 2022/0249913 A1 Aug. 11, 2022

Related U.S. Application Data

(60) Provisional application No. 63/296,056, filed on Jan. 3, 2022, provisional application No. 63/146,082, filed on Feb. 5, 2021.

(51) Int. Cl.

| | |
|---|---|
| ***A63B 31/10*** | (2006.01) |
| ***A63B 31/02*** | (2006.01) |
| ***A63B 69/12*** | (2006.01) |

(52) U.S. Cl.

CPC ..... *A63B 31/10* (2013.01); *A63B 69/12* (2013.01); *A63B 31/02* (2013.01); *A63B 2225/60* (2013.01); *A63B 2244/20* (2013.01)

(58) Field of Classification Search

CPC ..... A63B 31/10; A63B 69/12; A63B 2225/60; A63B 2225/62; A63B 2225/605; A63B 2244/20; A63B 31/04

See application file for complete search history.

(56) References Cited

U.S. PATENT DOCUMENTS 689,840 A * 12/1901 Jensen ..... A63B 31/04 2/160
2,536,390 A 1/1951 Pobochenko
(Continued)

FOREIGN PATENT DOCUMENTS

KR 10-2015-0086581 A 7/2015
RU 188 379 U1 4/2019
WO WO-2017151917 A1 * 9/2017 ..... A41D 13/0512

OTHER PUBLICATIONS

FINIS Alignment Kickboard by GoSwim, By Swimshop, Retrieved from https://www.youtube.com/watch?v=XCg9KT9JUqc>, 2 pages (Apr. 10, 2015).

(Continued)

*Primary Examiner* — Peter S Vasat
(74) *Attorney, Agent, or Firm* — Merchant & Gould P.C.

(57) ABSTRACT

A swim training device includes: (a) a platform having a top side and a bottom side, and extending longitudinally from a leading edge to a trailing edge and extending laterally from a left side to a right side; and (b) a hands pocket located on the top side of the platform and including a hands entry opening facing toward the trailing edge of the platform, wherein: (i) the hands pocket is constructed to receive a user's hands through the hands entry opening so that the user's hands are located in the hands pocket in a generally extended configuration; (ii) the hands pocket is constructed to hold the user's hands in place in the generally extended configuration against the top side of the platform; and (iii) the hands pocket is constructed to resist longitudinal and lateral movement of the user's hands relative to the platform when the user's hands are located within the hands pocket.

31 Claims, 30 Drawing Sheets

(56) References Cited

U.S. PATENT DOCUMENTS

| | | | | |
|---|---|---|---|---|
| 2,556,894 | A | 6/1951 | Axiotes | |
| 3,922,740 | A | 12/1975 | Potter | |
| 4,240,171 | A * | 12/1980 | Parsons | A63B 69/14 441/56 |
| 4,437,842 | A | 3/1984 | Connor | |
| 4,522,603 | A * | 6/1985 | Doyle | B63B 32/35 441/68 |
| 4,676,760 | A * | 6/1987 | Massbaum | A63B 31/04 441/88 |
| 4,781,637 | A * | 11/1988 | Caires | A63B 31/10 441/64 |
| 5,009,623 | A * | 4/1991 | Lueschen | A63B 31/10 441/56 |
| 5,171,178 | A * | 12/1992 | Creek | B63B 34/565 441/132 |
| 8,341,765 | B2 | 1/2013 | Brodbeck | |
| 9,522,303 | B2 | 12/2016 | Kim | |
| 9,834,286 | B2 | 12/2017 | Rubey | |
| 10,384,093 | B2 | 8/2019 | Peloquin et al. | |
| 10,912,977 | B1 * | 2/2021 | Fuller | A63B 69/125 |
| 11,331,541 | B2 | 5/2022 | Kim | |
| 2005/0215135 | A1 | 9/2005 | Hall | |
| 2008/0014810 | A1 | 1/2008 | Mix | |
| 2009/0156072 | A1 * | 6/2009 | Sick | A63B 69/0093 441/65 |
| 2011/0111655 | A1 * | 5/2011 | Pakhomov | B63H 16/08 441/56 |
| 2014/0079900 | A1 * | 3/2014 | Ramirez | C09J 7/21 442/101 |
| 2014/0364280 | A1 | 12/2014 | Haldeman | |
| 2015/0056878 | A1 | 2/2015 | Watchorn | |
| 2018/0133574 | A1 | 5/2018 | Evans et al. | |
| 2020/0114209 | A1 | 4/2020 | Gerona | |
| 2022/0241651 | A1 | 8/2022 | Kim | |

OTHER PUBLICATIONS

International Search Report and Written Opinion for Application No. PCT/US22/15352 mailed May 6, 2022.

Alignment Kickboard at https://www.finisswim.com/Alignment-Kickboard, Finis, Inc.3 pages (available at least as early as Feb. 5, 2021).

Partial Supplementary European Search Report for European Application No. EP 22750484.2 dated Jan. 7, 2025.

* cited by examiner

DEVICE FOR LEARNING AND TRAINING THE UNDERWATER DOLPHIN KICK AND METHODS

CROSS REFERENCE TO RELATED APPLICATIONS

This application claims the benefit of U.S. provisional patent application Ser. No. 63/146,082 filed with the United States Patent and Trademark Office on Feb. 5, 2021 and U.S. provisional patent application Ser. No. 63/296,056 filed with the United States Patent and Trademark Office on Jan. 3, 2022, to the extent appropriate. The entire disclosures of U.S. Application Ser. No. 63/146,082 and U.S. Application Ser. No. 63/296,056 are incorporated herein by reference.

FIELD OF THE DISCLOSURE

The present disclosure relates to a swim training device for assisting in learning and training the underwater dolphin kick, and to methods for learning and training the underwater dolphin kick.

BACKGROUND OF THE INVENTION

In recent decades, the underwater dolphin kick has increased in popularity in competitive swimming. It is generally recognized that high level swimmers performing the underwater dolphin kick technique can actually swim faster while under water compared to swimming on the surface of the water. Taking advantage of the underwater dolphin kick also has the advantage of using different muscle groups compared to swimming on the surface of the water and this provides certain advantages. In view of this, there is increased interest among all levels of swimmers to learn and use the underwater dolphin kick during competitions. Various governing bodies for the sport have placed restrictions on the extent to which swimmers are legally allowed to utilize the underwater dolphin kick after pushing off from a wall during a sanctioned race.

Although the underwater dolphin kick technique may come naturally to certain people, it is a technique that is difficult for many swimmers to learn, and it may take a considerable amount of practice to become proficient in the technique. Additionally, swimmers must train the underwater dolphin kick while under water, and this makes learning and developing the technique more difficult since they are depriving their body of oxygen. Training the underwater dolphin kick also builds strength and speed. Accordingly, it is desirable to provide a device that provides feedback to help the swimmer learn the underwater dolphin kick and to also help the swimmer train the technique to become more proficient at it.

Devices generally known as kickboards have been around for decades. In a simplified form, they are often made of a foam board that floats on the surface of the water, and a swimmer generally holds onto the sides to train a particular kicking technique. Often, such foam boards have a density of less than about 0.1 g/cc to ensure that they are sufficiently buoyant in water. Exemplary alternative kickboard designs are depicted in, for example U.S. Pat. Nos. 10,384,093 and 4,240,171. A kickboard product presently on the market is sold under the name "Alignment Kickboard" at https://www.finisswim.com/Alignment-Kickboard. Additional devices traditionally available for training swimmers include hand paddles attached to each hand, and fins placed on the feet. These devices have drawbacks when used for learning and training the underwater dolphin kick.

SUMMARY

A swim training device is provided according to the present disclosure. The swim training device includes: (a) a platform having a top side and a bottom side, and extending longitudinally from a leading edge to a trailing edge and extending laterally from a left side to a right side; and (b) a hands pocket located on the top side of the platform and including a hands entry opening facing toward the trailing edge of the platform, wherein: (i) the hands pocket is constructed to receive a user's hands through the hands entry opening so that the user's hands are located in the hands pocket in a generally extended configuration; (ii) the hands pocket is constructed to hold the user's hands in place in the generally extended configuration against the top side of the platform; and (iii) the hands pocket is constructed to resist longitudinal and lateral movement of the user's hands relative to the platform when the user's hands are located within the hands pocket.

An alternative swim training device is provided according to the present disclosure. The swim training device includes: (a) a platform having a top side and a bottom side, and extending longitudinally from a leading edge to a trailing edge and extending laterally from a left side to a right side, and a chamber therein constructed to be filled with air, water, or a combination of air and water; and (b) a hands pocket located on the top side of the platform and including a hands entry opening facing toward the trailing edge of the platform, wherein: (i) the hands pocket is constructed to receive a user's hands through the hands entry opening so that the user's hands are located in the hands pocket and arranged and in a generally extended configuration; (ii) the hands pocket is constructed to hold the user's hands in place in the generally extended configuration against the top side of the platform; and (iii) the hands pocket is constructed to resist longitudinal and lateral movement of the user's hands relative to the platform, and movement away from the platform, when the user's hands are located within the hands pocket.

A method for learning or training an underwater dolphin kick is provided according to the present disclosure. The method includes: (a) placing a user's hands in a hands pocket of a training device; and (b) pushing off from a wall while under water and alternately pushing down and pulling up on the training device to generate the dolphin kick.

DETAILED DESCRIPTION

The underwater dolphin kick, when done property, has potential to propel a swimmer faster than swimming any stroke on the surface of the water. During a competition sanctioned by a governing body, such as USA Swimming or Federation Internationale de Natation (FINA), the rules permit the swimmer, after pushing off the wall in a freestyle, backstroke, or butterfly event to get into a streamline position with arms locked above and behind their head and perform the underwater dolphin kick for a certain distance. Under current rules, the swimmer can only perform the underwater dolphin kick for 15 meters after pushing off a wall, and the swimmer's head must be on the surface of the water by the 15 meter mark from the wall.

Competitive swimmers have an incentive to want to learn and improve their underwater dolphin kick technique because it has the potential of being faster than swimming on the water. When done correctly, the underwater dolphin kick is initiated in the upper body, including the arms and shoulders. A resulting wave action toward the toes is very efficient for propelling a swimmer, under water, in a forward direction. Many swimmers find it difficult to feel how the underwater dolphin kick is initiated, and there is a tendency to believe the technique begins in the hips. To provide feedback that helps a swimmer understand and feel the forces in play when correctly performing the underwater dolphin kick and to also develop muscle memory, the training device described herein can be utilized for benefit. In addition, those who know how to perform the underwater dolphin kick can utilize the training device to help improve performance because the training device can provide feedback thereby correcting technique even as the swimmer becomes fatigued, and the swimmer's underwater dolphin kick starts to fail. By forcing the swimmer to continue with the correct technique especially as the swimmer becomes fatigued, the training device can help improve and strengthen technique. Kicking under water also deprives the body of oxygen thereby making it difficult to train. Using a training device that provides feedback while under water increases the efficiency of training under water thereby accelerating development of muscle memory, strength, speed, and efficiency.

Figure 1:
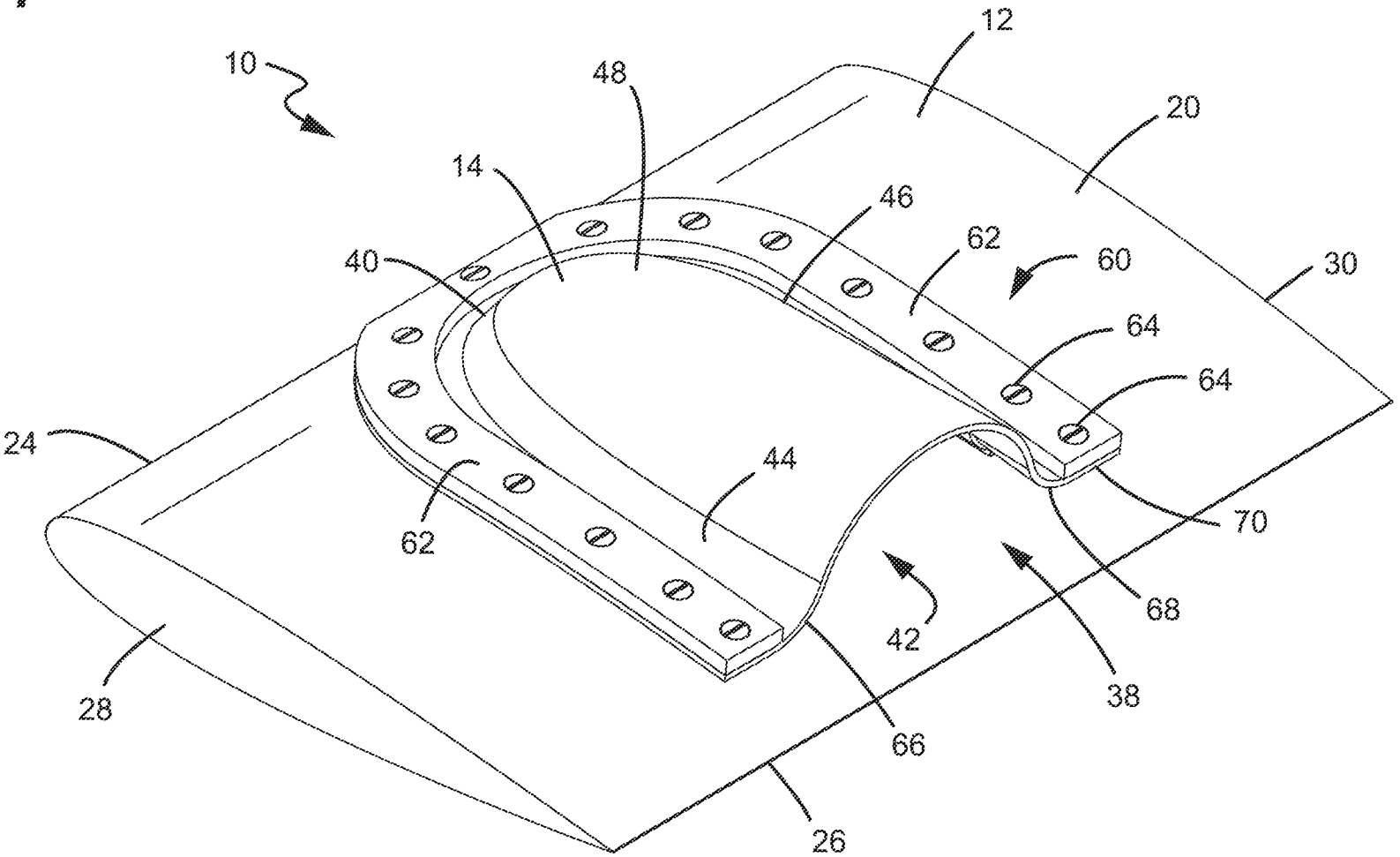
FIG. 1 is a perspective top, left side, and trailing edge view of a swim training device according to the present disclosure.
Figure 1A:
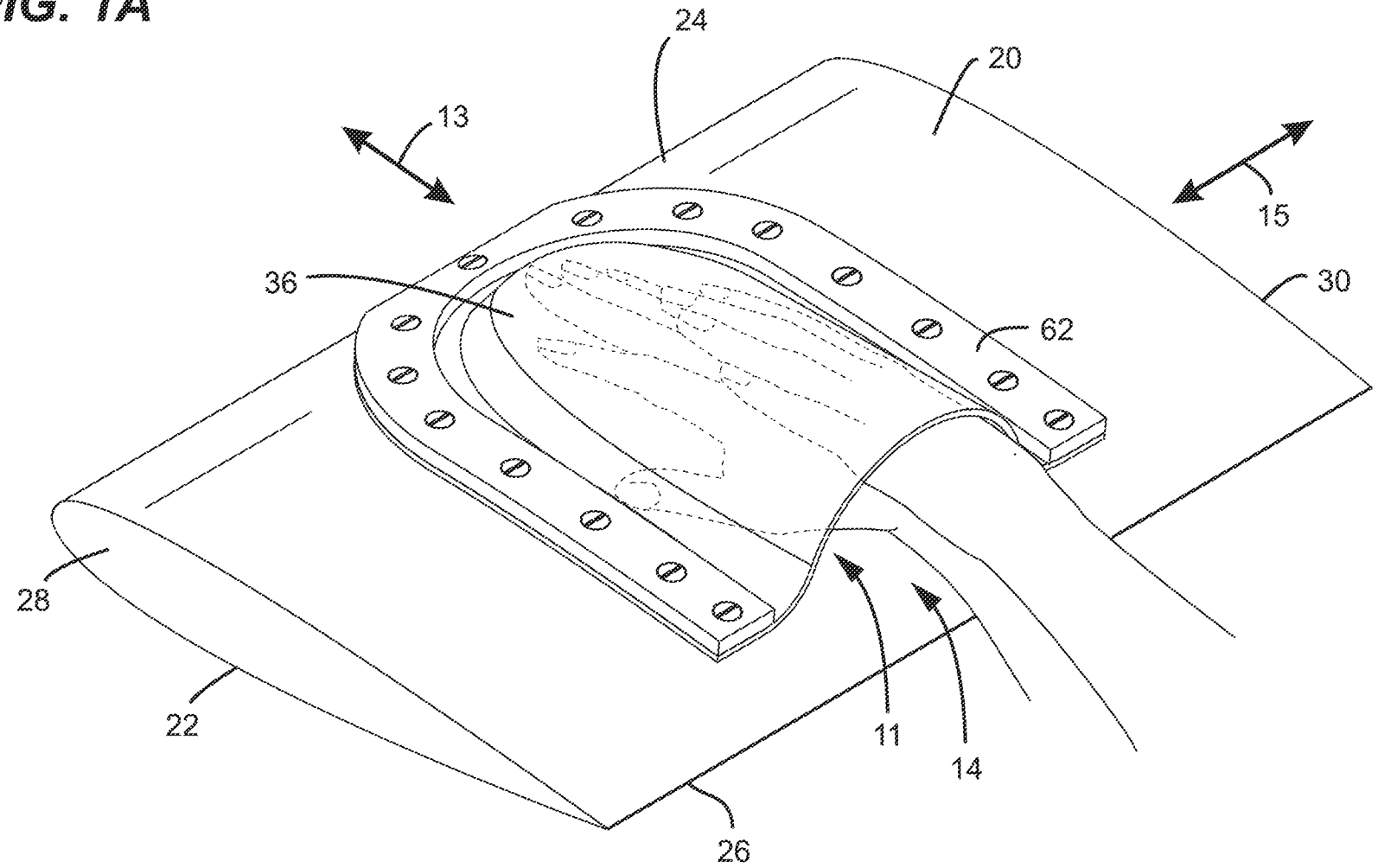
FIG. 1A is a perspective view showing the swim training device of FIG. 1 with a user's hands arranged in the hands pocket.
Figure 2:
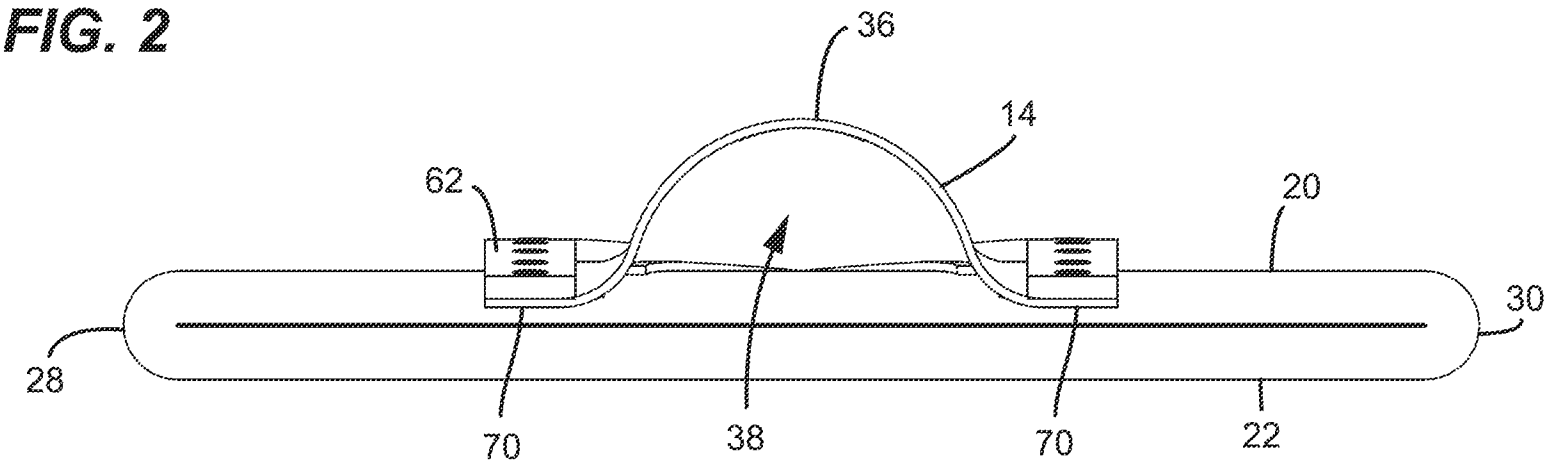
FIG. 2 is a rear plan view of the swim training device of FIG. 1.
Figure 3:
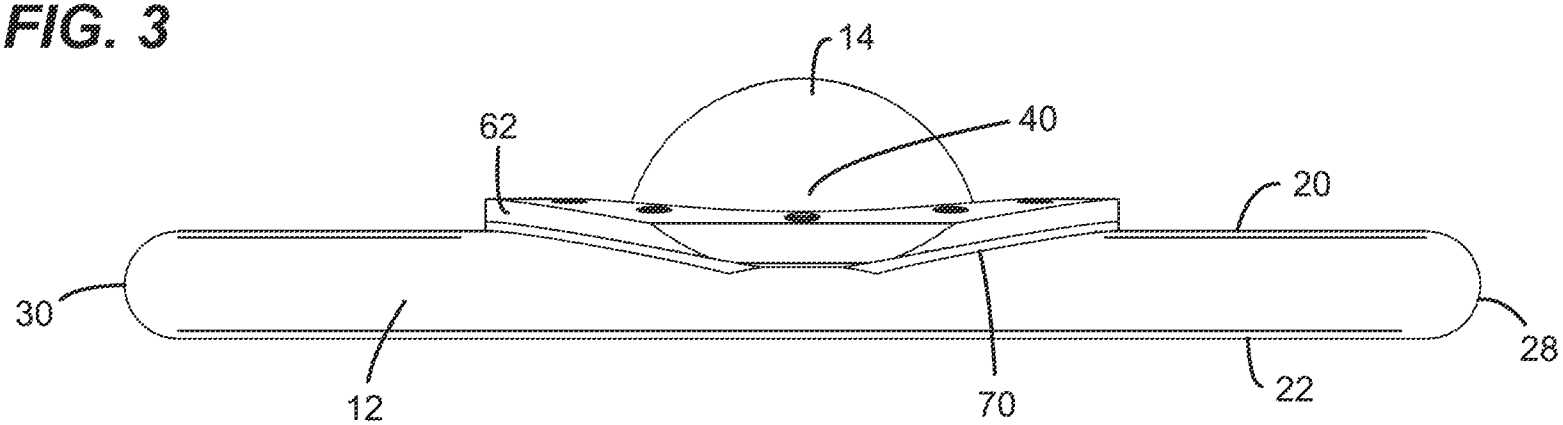
FIG. 3 is a front plan view of the swim training device of FIG. 1.
Figure 4:
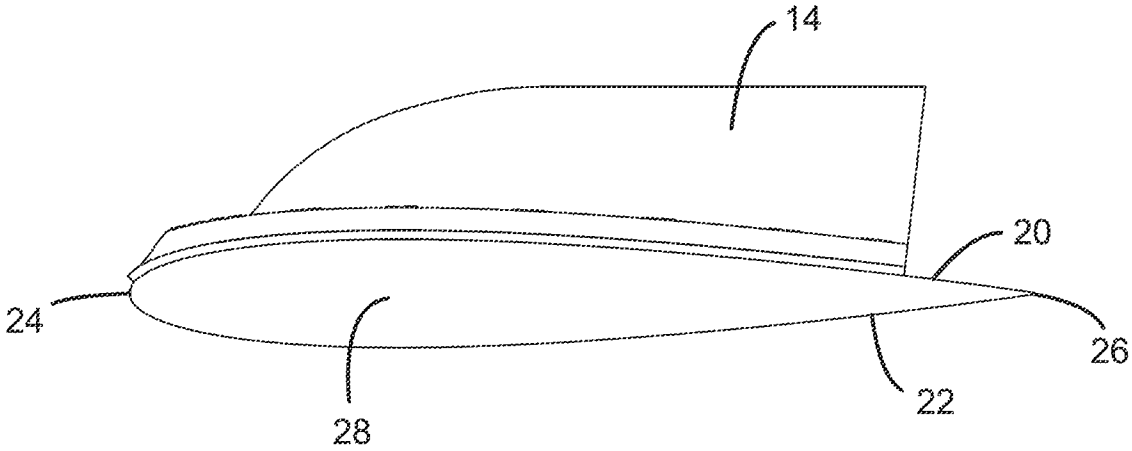
FIG. 4 is a left side plan view of the swim training device of FIG. 1.
Figure 5:
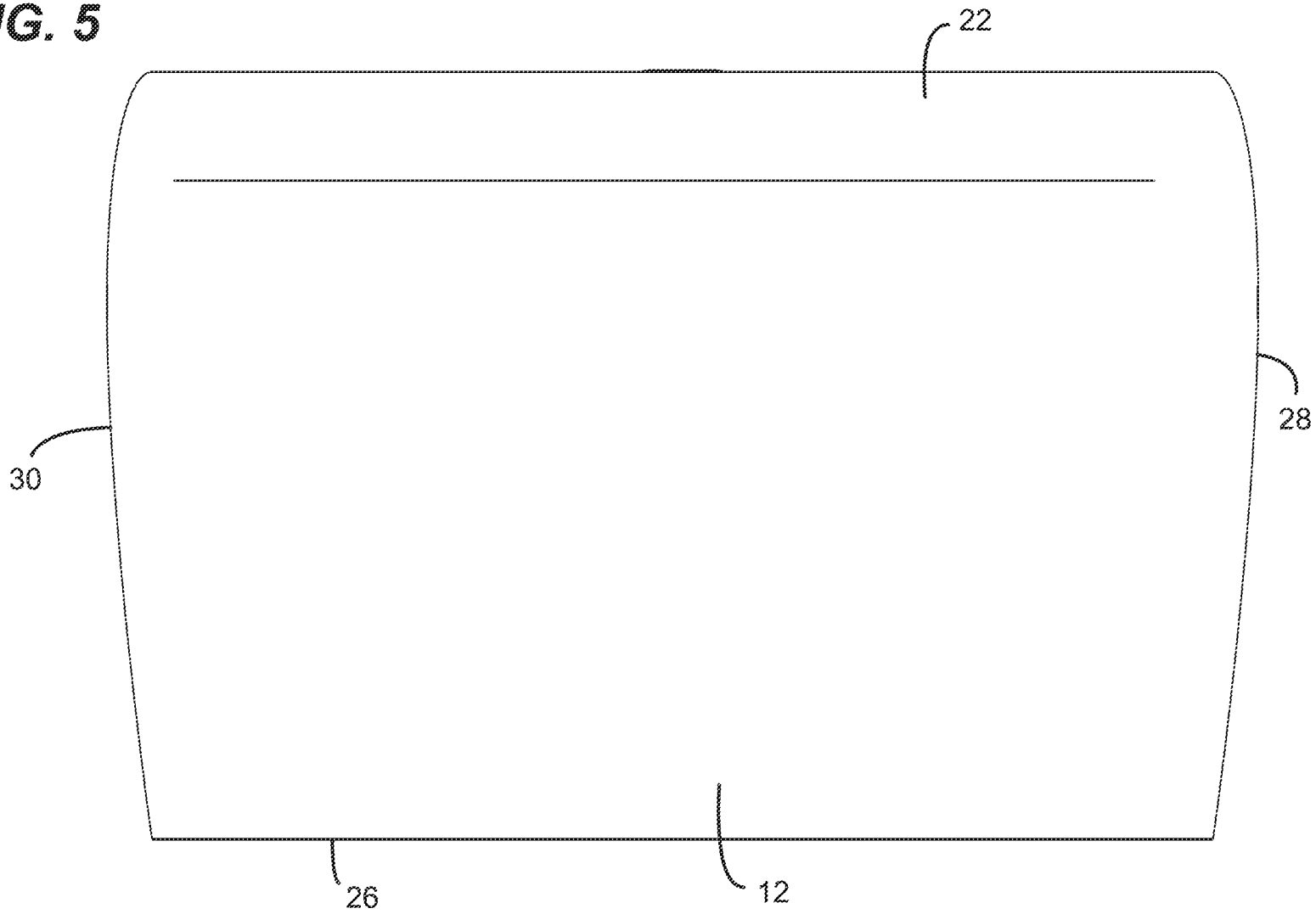
FIG. 5 is a bottom view of the swim training device of FIG. 1.
Figure 6:
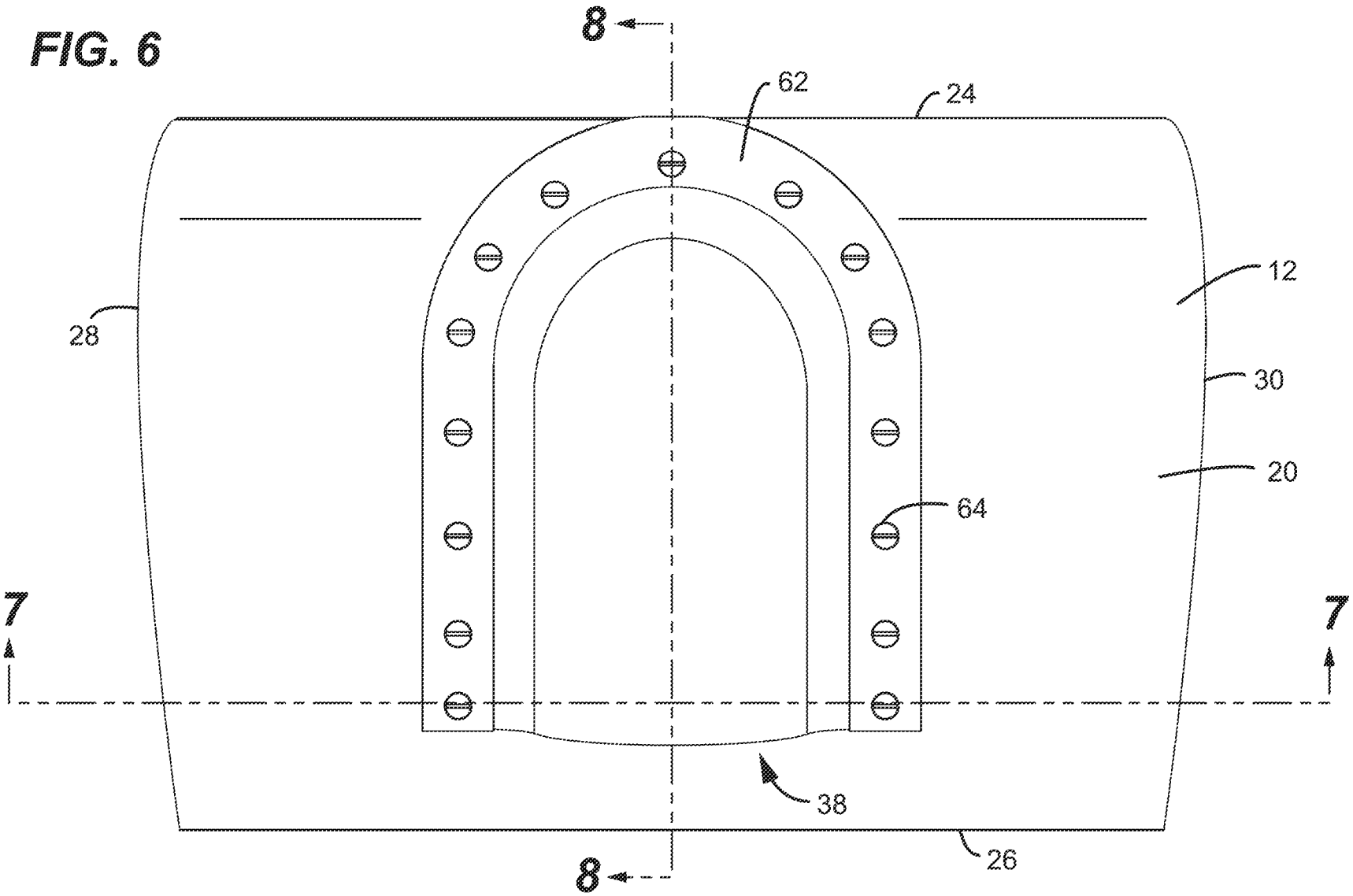
FIG. 6 is a top view of the swim training device of FIG. 1.
Figure 7:
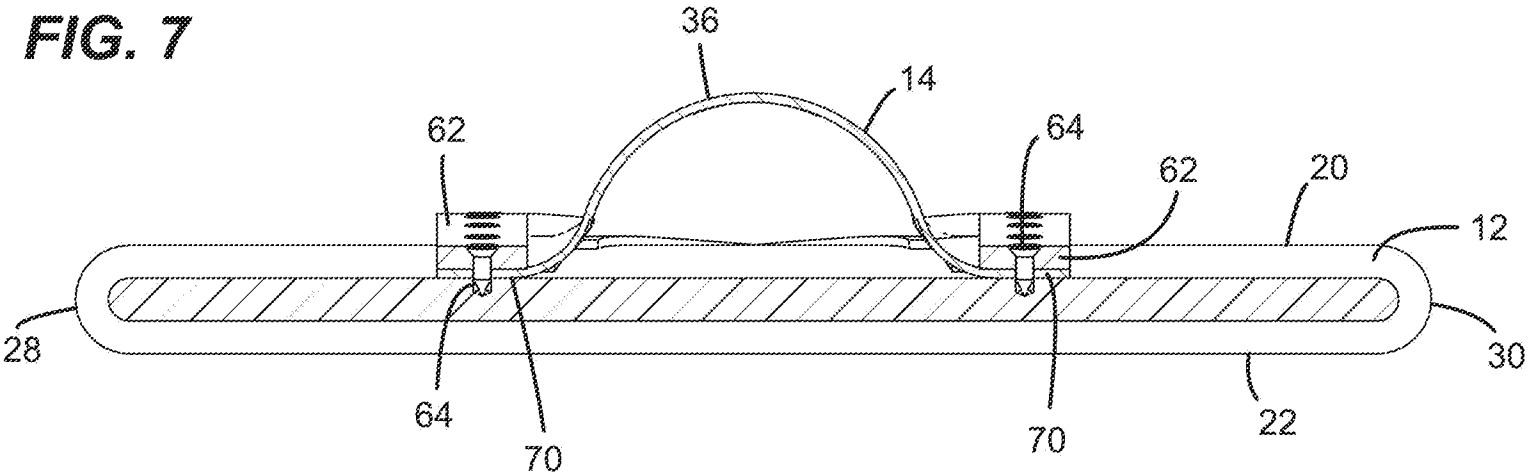
FIG. 7 is a sectional view of the swim training device shown in FIG. 6 taken along lines 7-7.
Figure 8:
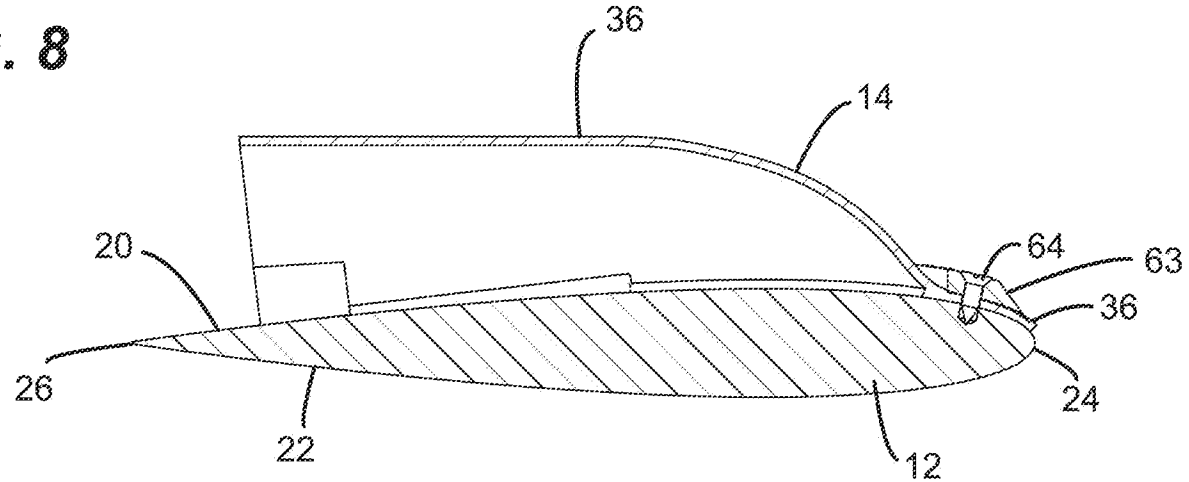
FIG. 8 is a sectional view of the swim training device shown in FIG. 6 taken along lines 8-8.

Referring to FIGS. 1-10A, an exemplary training device is depicted at reference number 10. The training device 10 can be referred to more simply herein as the device. The training device 10 includes a platform 12 and a hands pocket 14. As illustrated in FIG. 1A, a user's hands 11 are shown located in the hands pocket 14 extending generally flat and one hand on top of the other in a hand-over-hand arrangement that corresponds to a streamline position. The position of the hands 11 inside the hands pocket 14 generally corresponds to how the hands will be arranged when performing the underwater dolphin kick without the training device 10. That is, the hands (and fingers) will generally extend along a line that is generally consistent with the line of extension formed by the forearms. The hands are not supposed to be cupped or balled, but rather should be as flat as possible although a certain amount of curvature may be acceptable as long as it does not negatively affect the streamline position. As shown in FIG. 1A, the hands rest on top of the platform 12 and inside the hands pocket 14. Although shown in a hand-over-hand arrangement, alternatives are possible.

The hands pocket 14 preferably provides a relatively snug fit for the hands so that the hands resist moving longitudinally and laterally relative to platform 12 when using the training device 10, and also provides that the hands remain adjacent to the platform 12 during the underwater dolphin kick and do not significantly separate from the platform 12. The longitudinal direction refers to the direction along the arrows 13 and the lateral direction refers to the direction along the arrows 15. In general, the longitudinal direction extends along the intended direction of travel, and the lateral direction is transverse to the longitudinal direction. It is important that the swimmer's hands, including the fingers and palms, remain reasonably secured to the platform 12 during use of the training device 10. If there is too much separation, it is expected that the swimmer will lose the appropriate feel of the device, and the separation may cause the device to interfere with the training by creating flutter. Flutter can happen if the hands pocket 14 permits too much separation between the hands 11 and the platform 12 so that the platform 12 tends to "catch" the water rather than cutting through the water. Some level of separation may be permitted, such as, for example, less than 0.5 inch or preferably less than 0.25 inch. More preferably, there is no separation between the hands 11 and the platform 12 during use. Furthermore, the hands 11 can be held against the platform 12 without gripping the platform 12. Preferably, the hands 11 are held sufficiently tightly to so that the platform 12 can be considered an extension of the hands 11.

The platform 12 includes a top side 20 and a bottom side 22, and the top side 20 and the bottom side 22 extend from a leading edge 24 to a trailing edge 26, and from a left edge 28 to a right edge 30. During use, the leading edge 24 cuts through the water and the user's wrists or forearms generally extend over the trailing edge 26. The length of the platform 12 from the leading edge 24 to the trailing edge 26 can be any desired length but should be a length that permits the user to feel how alternately tipping the leading edge 24 upwardly and downwardly induces the user's wave or dolphin motion through the water.

It is pointed out that the training device 10 is intended to be used when the swimmer is under the surface of the water rather than on the surface of the water, so that the training device 10 is under water when used. As will be apparent from the following description, a benefit of the training device 10 is that it resists forces applied in both a direction opposite the top side 20 and in a direction opposite the bottom side 22. This resistance to forces is provided because water is present on both sides of the training device 10, during use. This can be referred to as leveraging the platform 12 both upwardly and downwardly. Leveraging downwardly can be considered a "pressing" force and leveraging upwardly can be considered a "lifting" force. In a traditional kickboard that floats on the surface of the water, there is resistance to a force applied downwardly (into the surface of the water) but there is essentially no corresponding resistance to a force in the opposite direction (away from the water surface in a lifting direction) because the kickboard is resting on the water surface. While there may be some resistance to a lifting force by a traditional kickboard on the surface of the water, there is generally not a sufficient amount of resistance to a lifting force to learn and train the underwater dolphin kick. For the training device 10 in use, water resists forces applied in both directions opposite the top side 20 and opposite the bottom side 22. While there is no restriction on using the training device 10 on the water surface like a traditional kickboard, it should be understood that the benefit of resisting forces against the top side 20 and against the bottom side 22, will be lost if the device is used on the water surface since one side (i.e., the top side 20) will not have water opposing a lifting force. It is also apparent from the description below that resisting forces in both directions (that is, the pressing force and the lifting force) is beneficial for teaching and training the underwater dolphin kick.

Although the following description may at times refer to a direction as upwardly or downwardly, it should be appreciated that this characterization is relative to the user of the device and not necessarily in an absolute sense. In other words, the reference to tilting the leading edge 24 of the device upwardly should be understood to mean tilting relative to the plane that the device is in, and the plane can actually be non-perpendicular to the water surface. Similarly, reference to a vertical direction may also be relative and is used to provide convenience in description. It is pointed out the training device 10 is not required to be used in a particular orientation. While one possible orientation is flat or parallel to the water surface, the training device 10 can be oriented on its side or slanted at any angle. In fact, when the swimmer using the training device 10 pushes off from a wall in a pool, the swimmer may very well be pushing off at an angle that is not parallel to the water surface. What is important is that there is water opposite both the top side 20 and the bottom side 22 to resist forces applied in those directions, during use.

The reference herein to swimming underwater and swimming below the surface of the water are meant to describe essentially the same thing. There is no requirement of being a certain distance below the water surface. Performing the underwater dolphin kick means that the swimmer is sufficiently below the water surface so that the swimmer can apply forces against water on both the top and bottom sides of the swimmer's body. To effectively utilize the forces that can be generated when performing the underwater dolphin kick, there needs to be a layer of water between the swimmer and the water surface.

The distance between the left edge 28 and the right edge 30 can be selected to provide the swimmer with the desired level of user feedback. This is described in more detail below, but the general principle is that a larger surface area for the top side 20 and the bottom side 22 permits the swimmer to better feel how the pressure applied by the swimmer's hands/forearms in both a downwardly direction and an upwardly direction can translate into a wave movement throughout the swimmer's body. In the situation where the swimmer is learning the underwater dolphin kick, a larger surface area for the top side 20 and the bottom side 22 may be more advantageous by forcing the swimmer to use certain muscles, but as the swimmer improves and develops the appropriate muscle memory, the swimmer may benefit from using a training device 10 having a smaller surface area for the top side 20 and the bottom side 22. The training device 10 with a smaller surface area may be faster, more maneuverable, and better simulate competition compared to the training device 10 with a larger surface area.

The hands pocket 14 is provided to hold the user's hands against the top side 20 of the platform 12. In the arrangement shown, the hands pocket 14 includes a cover 36 that extends from the platform top side 20 to thereby snugly hold the user's hands within the hands pocket 14 and against the top side 20 of the platform 12. As illustrated, the cover 36 forms an enclosure 38 extending from the pocket forward end 40 and limiting the movement of the user's fingertips in a direction toward the platform leading edge 24 and extending from the forward end 40 toward the pocket opening 42 that is large enough to permit the user to introduce both hands into the hands pocket 14. In addition, the cover 36 extends from the pocket left side 44 to the pocket right side 46 thereby limiting movement of the user's hands in the lateral (leftward and rightward) directions.

The hands pocket 14 illustrated can be characterized as a closed pocket 48 because the pocket has a single pocket opening 42, and it is through that single pocket opening 42 that the user can introduce and withdraw his or her hands from the hands pocket 14, and the remainder of the hands pocket 14 is generally closed. One way to characterize the pocket as a closed pocket 48 is the ability to resists flow of water into the hands pocket 14 from any side other than the pocket opening 42. Although the hands pocket 14 illustrated is a closed pocket 48, alternatives are possible. Being a closed pocket 48 has an advantage of reducing drag that may occur if the pocket has an opening to the enclosure 38 where water can thereby flow into the enclosure 38. If desired, openings can be provided that allow water to flow into the enclosure 38 other than through the pocket opening 42. As long as the cover 36 sufficiently holds the user's hands against the top side 20 of the platform 12, the hands pocket 14 can be provided as an open pocket. If the hands pocket includes an opening forward of the hands, it can be sized to allow the fingers to move forward to the leading edge of the platform which provides certain advantages including greater ease of maneuverability by being able to apply more pressure on the leading edge. In addition, placing fingers through such an opening may permit greater pressure of the fingers thereby keeping them on the platform. An exemplary open pocket is described in more detail below.

If the user's hands separate from the platform 12 during the underwater dolphin kick, that separation may cause flutter and have the effect of making it more difficult to learn and/or train the underwater dolphin kick. By way of example, the cover 36 preferably covers at least about 50% of the surface area of the hands, more preferably at least 75% of the surface area of the hands, and even more preferably at least 90% of the surface area of the hands, and up to 100%. The surface area of the hands can be measured from below the wrist to the fingertips.

The training device 10 includes a bracket assembly 60 that attaches the cover 36 to the platform 12. Although the training device 10 includes a bracket assembly 60, alternative embodiments of the training device, as described herein, do not require a bracket assembly. The bracket assembly 60 can include a bracket flange 62 and fasteners 64 that extend between the bracket flange 62 and the platform 12 through the top side 20. Exemplary fasteners 64 include screws and bolts. The bracket flange 62 is shown having a horseshoe shape extending generally from the left side 66 of the pocket opening 42 to the right side 68 of the pocket opening 42. The bracket flange 62, when attaching the cover 36 to the platform 12, forms the enclosure 38. The cover 36 can include a flange member 70 that is pinched between the bracket flange 62 and the top side 20 of the platform 20. Although a bracket assembly 60 is shown for attaching the cover 36 to the platform 12 to form the hands pocket 14, alternative ways of attaching the cover to the platform 12 can be provided.

As described previously, the length and width of the platform 12 can be adjusted to provide the desired level of resistance to force applied to the training device 10. In general, a larger surface area corresponds with more effort to move the training device forward but also provides stability and helps force the swimmer to provide the desired motion for the underwater dolphin kick. A smaller surface area may be more desirable for those who know the technique and are more interested in training the technique. In addition, a smaller surface area may correspond to the training device as having more maneuverability and velocity which may be desirable under certain circumstances. The training device 10 can be provided having a maximum width which is the largest width value from the left edge 28 to the right edge 30, and a maximum length which is the largest length between the leading edge 24 and the trailing edge 26. The term "maximum" is used because, as illustrated in later alternative embodiments, the leading edge and/or the trailing edge can be "swept" toward the other of the leading edge or the trailing edge. A similar situation applies with respect to the left edge and the right edge. In general, the training device can include a maximum width of about 8 inches to about 24 inches. In the case of the training device having a relatively large surface area, the maximum width can be about 14 inches to about 24 inches, and about 16 inches to about 21 inches. In the case of the training device having a relatively small surface area, the device can have a maximum width of about 8 inches to about 16 inches, and about 9 inches to about 14 inches. In addition, the training device can be provided as having essentially a compromise between a larger surface area and a smaller surface area. Such a device might have a maximum width of about 12 inches to about 18 inches. Furthermore, the amount of the surface area is affected by the length of the platform 12. The device can have a maximum length of about 5 inches to about 18 inches.

The training device 10 can be provided with a desired hydrodynamic shape as depicted, for example, in FIGS. 1, 1A, 4, and 8. The training device 10 is depicted having a rounded leading edge 24 where the top side 20 and the bottom side 22 curve from the leading edge 24 toward the trailing edge 26. As illustrated, the trailing edge 26 tapers to a knife edge although alternatives are possible. For example, the trailing edge 26 can be provided as rounded, if desired. In addition, the leading edge 24 and be provided with a knife edge, if desired. It is believed that this configuration provides hydrodynamic advantage when being pushed through water. Of course, alternative designs are available, and the shape of the platform 12 can be adjusted, if desired, to provide desired hydrodynamic effect. The shape of the top side 20 and the shape of the bottom side 22 can be provided with a desired hydrodynamic shape. There is no requirement that the shape of the top side 20 matches the shape of the bottom side 22, and they can be the same or different. One or more of the top side 20 and the bottom side 22 can be curved or cambered in either or both of the longitudinal direction and the transverse direction. Furthermore, the curve, if present on both the top side 20 and the bottom side 22, can be symmetrical or asymmetrical. There may be reasons why a symmetrical or asymmetrical curve is advantageous. The curve can be referred to as a camber, and the camber refers to a gap between the centerline of the cross-section of the wing from a line that connects the leading edge to the trailing edge. With no camber, the centerline is the same as the cord line that connects the leading and trailing edges. When positive or negative camber is introduced to the cross section, the centerline moves above or below the line connecting the leading and trailing edges.

Figure 9:
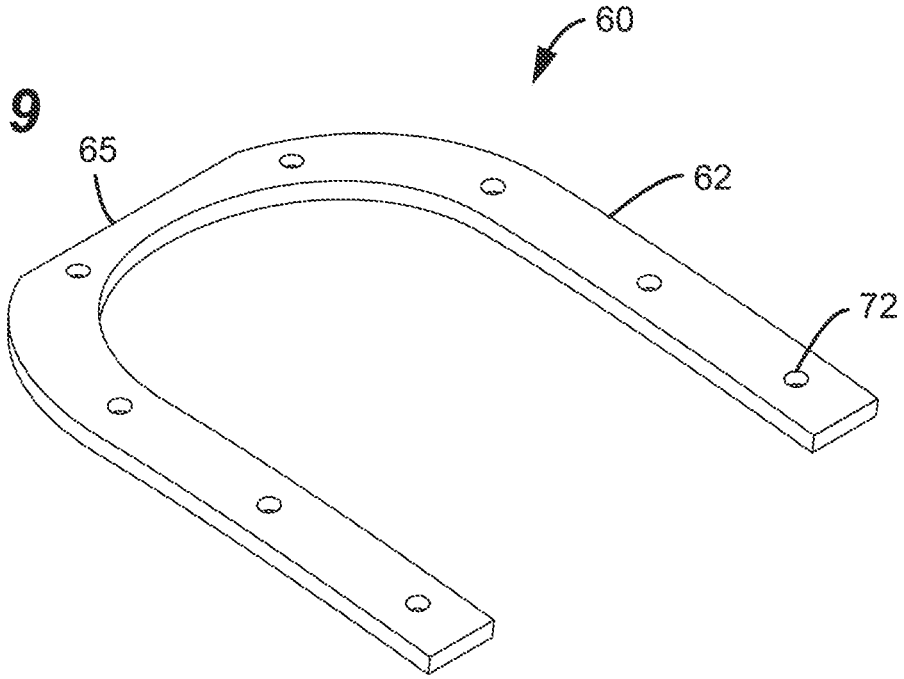
FIGS. 9-9B are perspective and side views of the bracket flange of the swim training device of FIG. 1.
Figure 9A:
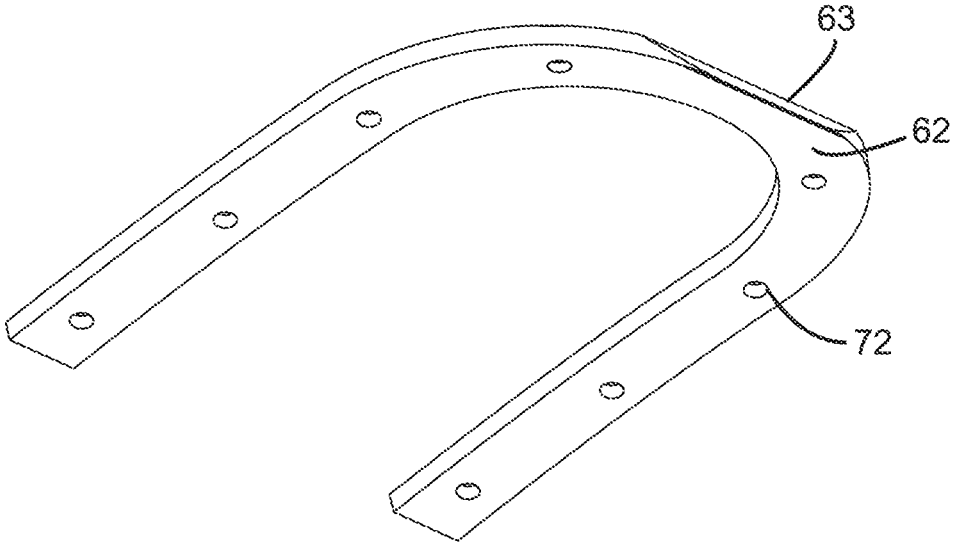
Figure 9B:
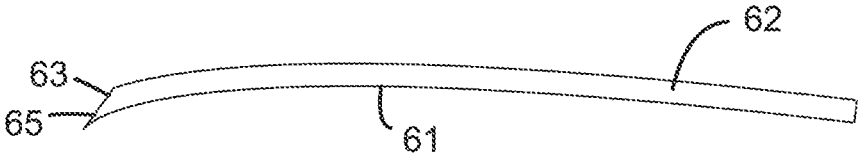
Figure 10:
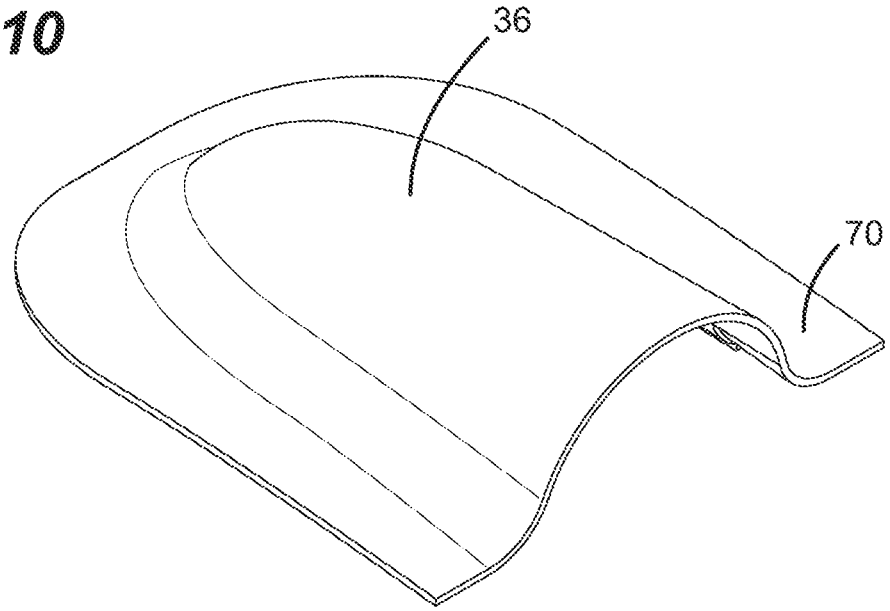
FIGS. 10 and 10A are perspective views of the cover of the swim training device of FIG. 1.
Figure 10A:
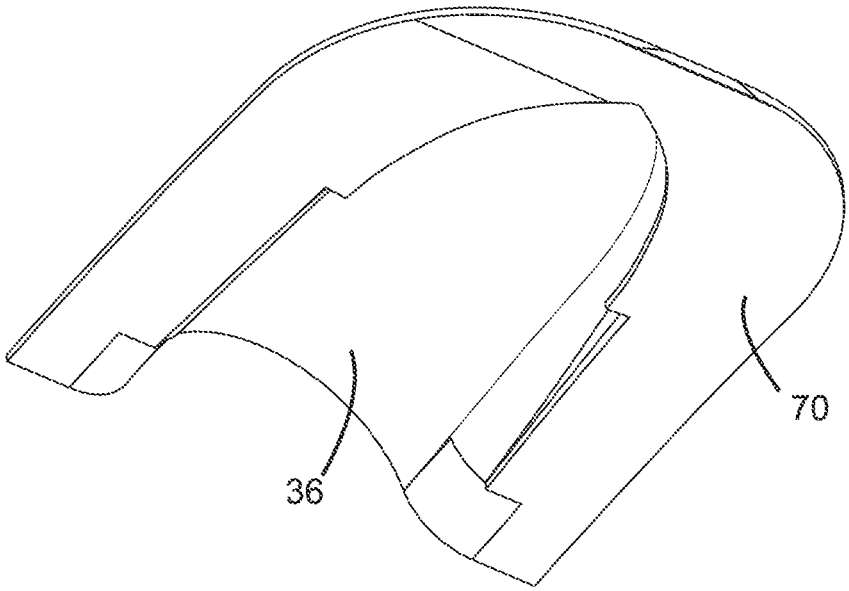

Now referring to FIGS. 9-10A. The bracket flange 62 and the cover 36 are illustrated in various parts and views. The bracket flange 62 is illustrated with holes or openings 72 to receive the fasteners 64. The bracket flange 62 is provided having a shape generally corresponding to a horseshoe shape. Furthermore, as illustrated, the bracket flange 62 is provided with a contour or curve 61 that generally follows the shape of the top side 20 of the platform 12. As illustrated, the bracket flange 62 includes a chamfer 63 along the leading edge 65 of the bracket flange 62 to provide an aerodynamic shape. The cover 36 similarly has a shape generally conforming to the shape of the top side 20 of the platform 12. The cover 36 forms an enclosure 38 with the platform 12, and the enclosure 38 generally has a shape corresponding to the outside shape of two hands in a hand over hand arrangement. The purpose of the bracket flange 62 is to hold the cover 36 to the platform 12.

Alternative Designs of the Training Device

Alternative designs of the training device are depicted to illustrate alternative features. It should be understood that the alternative features described herein in the various embodiments can be combined as desired to provide advantage.

Figure 11:
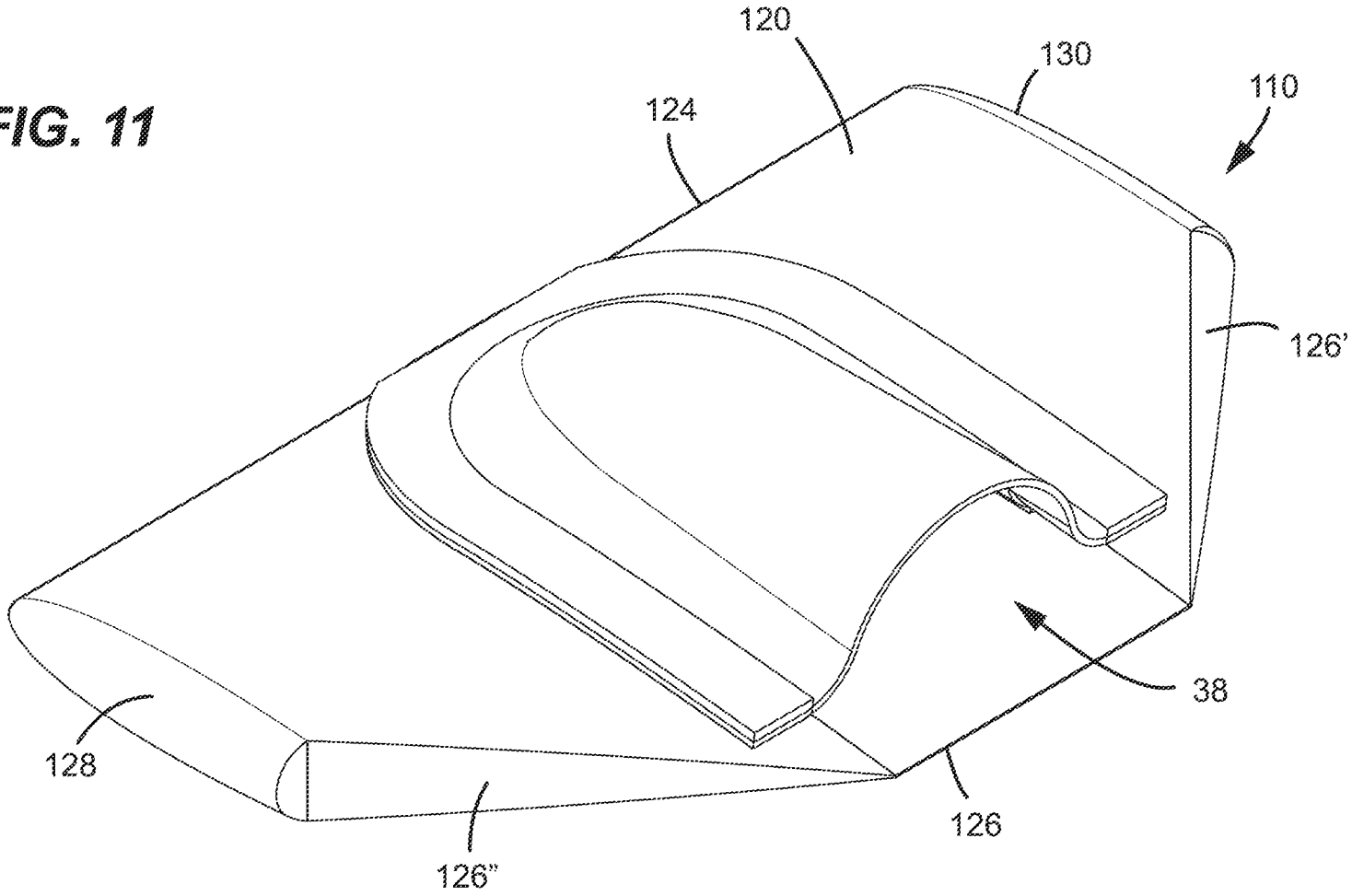
FIG. 11 is perspective view of an alternative embodiment of the swim training device according to the present disclosure.
Figure 12:
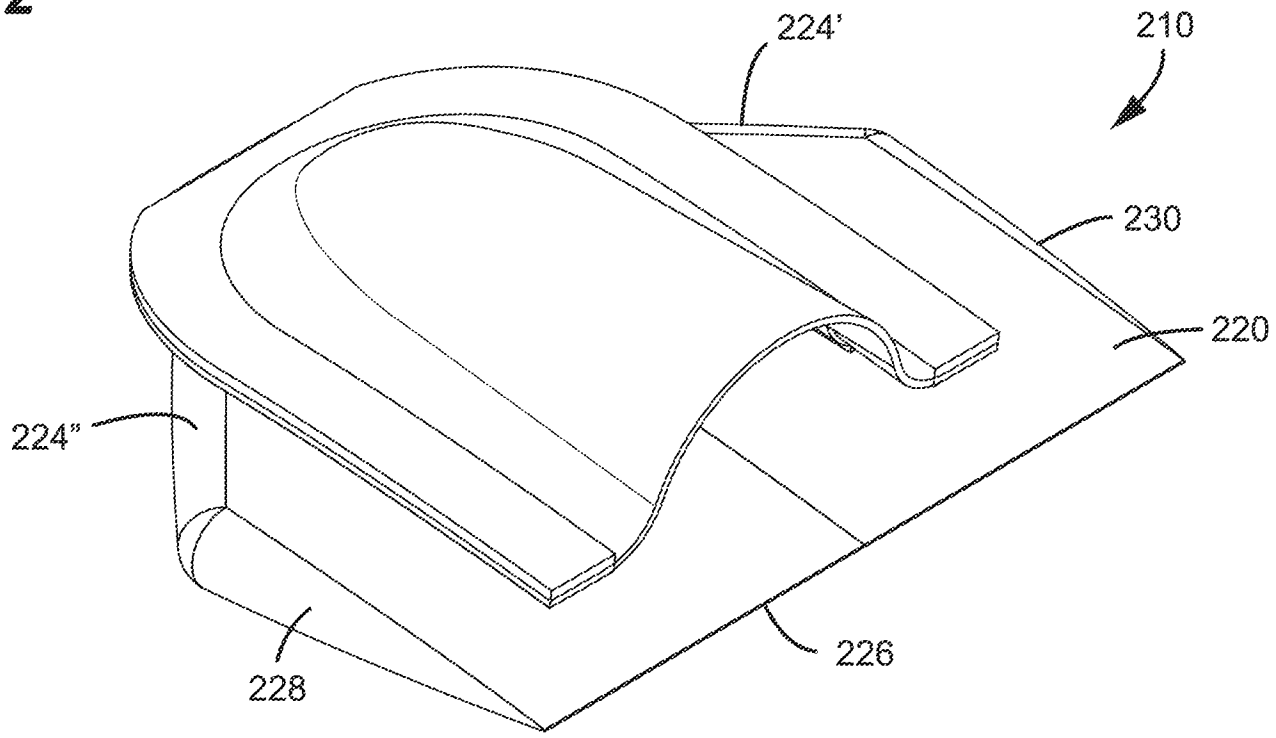
FIG. 12 is a perspective view of an alternative embodiment of the swim training device according to the present disclosure.
Figure 12A:
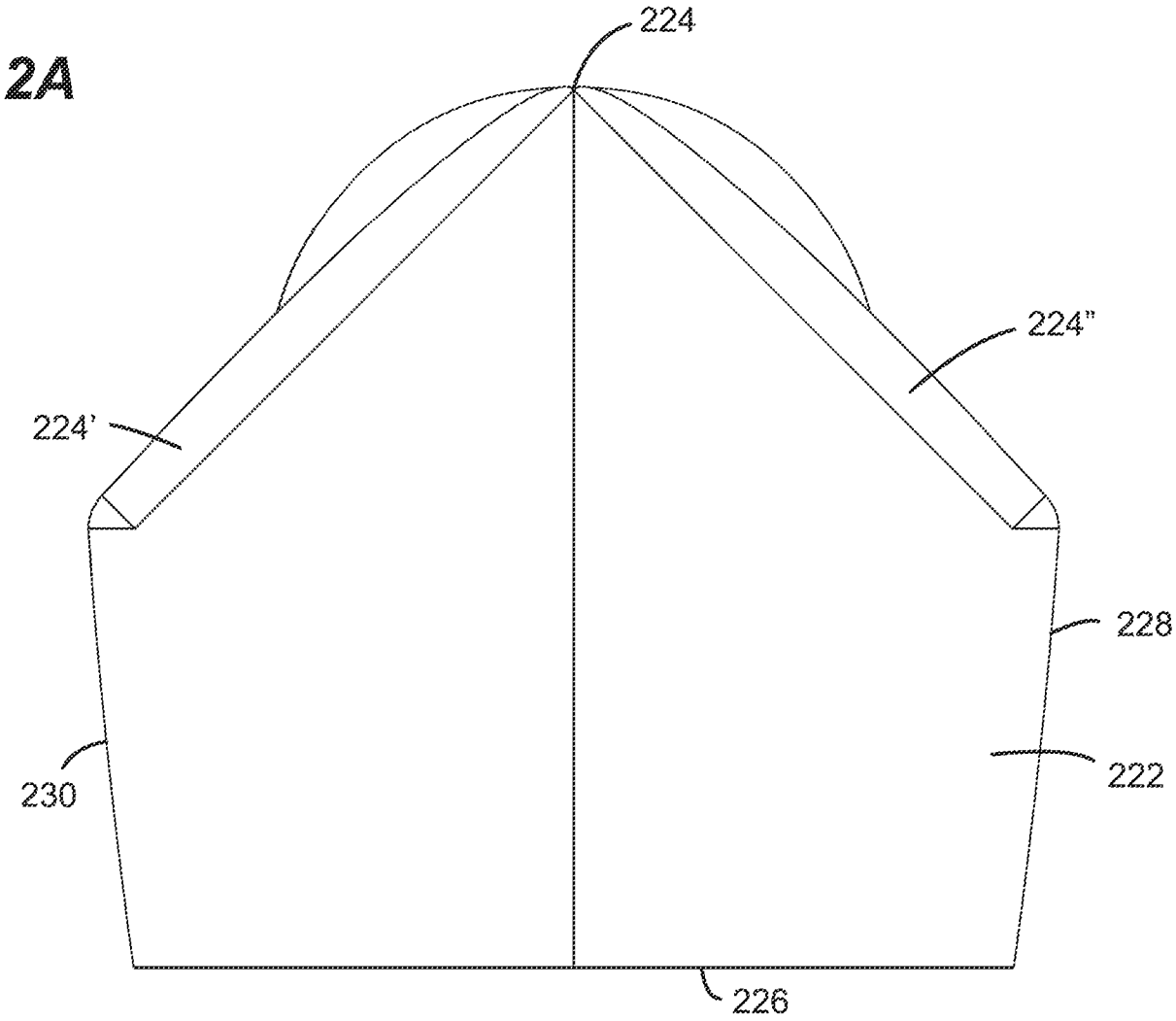
FIG. 12A is bottom view of the swim training device of FIG. 12.

Now referring to FIGS. 11-12A, alternative designs of the platform of the training device are depicted to provide desired properties. As discussed previously, the surface area of the platform provides resistance to forces applied upwardly and downwardly during use. The relative location of a greater or lesser amount of the surface area, either closer to the leading edge or closer to the trailing edge, can affect the performance of the training device.

Figure 11A:
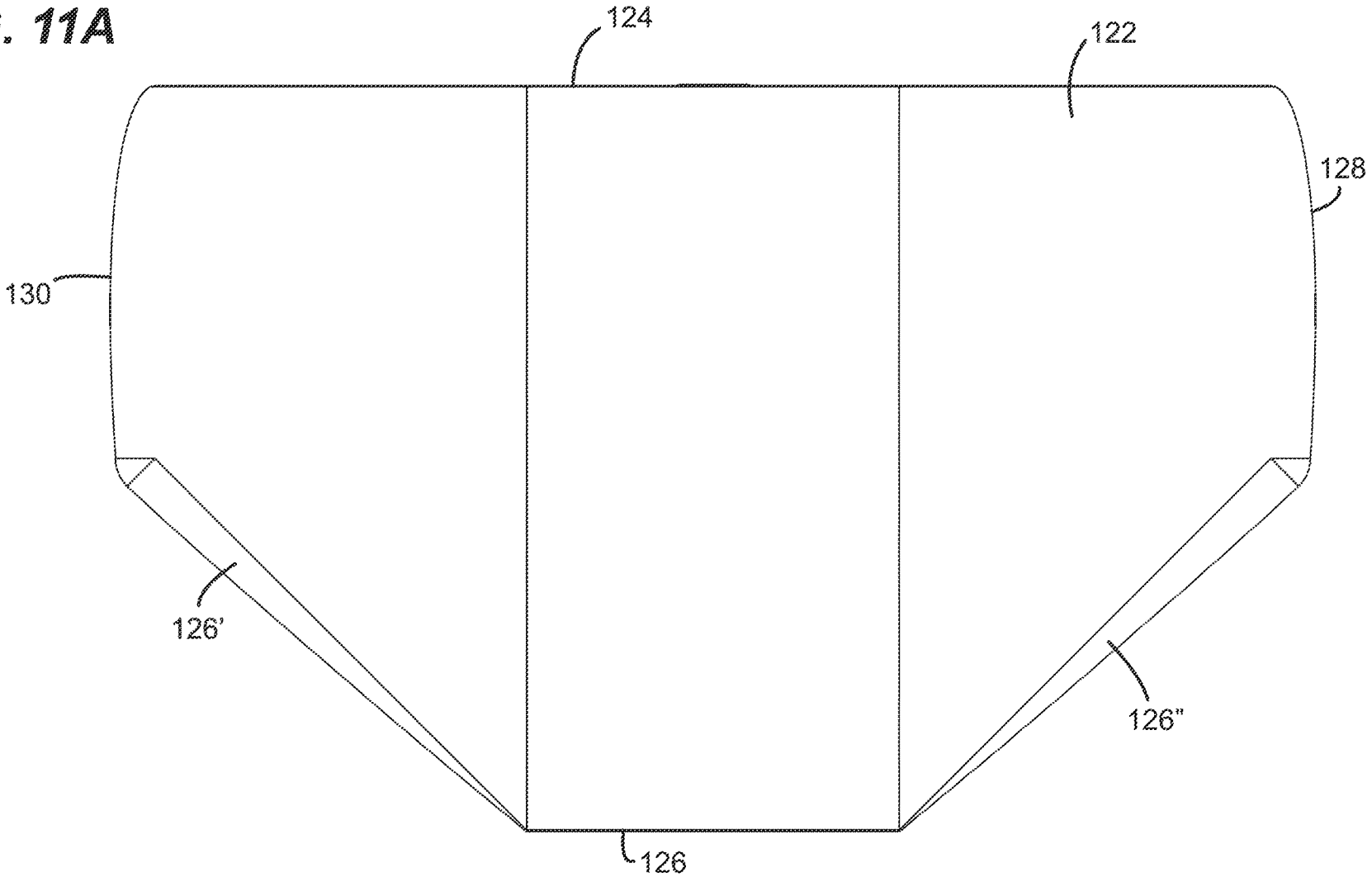
FIG. 11A is a bottom view of the swim training device of FIG. 11.

Now referring to FIGS. 11 and 11A, a training device 110 is depicted having a swept rearward edge 126. The forward edge 124 is similar to the forward edge 24 depicted in FIG. 1. The trailing edge 126, however, is shorter in view of the chamfer or bevel applied at 126' and 126". This design results in the left edge 128 and the right edge 130 being relatively shorter than the left edge 28 and the right edge 30 depicted in FIG. 1. The result of this design is that there is relatively more surface area of combined top surface 120 and bottom surface 122 closer to the leading ledge 124 than toward the trailing edge 126. This results in a training device 110 where the swimmer would need to apply greater force in the finger region compared to the palm region. This may have advantages in helping to train the underwater dolphin kick.

Now referring to FIGS. 12 and 12A, a training device 210 is depicted having a swept forward or leading edge 224. In the training device 210, the leading edge 224 is swept backward along chamfered or beveled edges 224' and 224" toward the trailing edge 226. In the embodiment shown, the leading edge 224 is depicted as essentially a point, but that can be lengthened, if desired. The left side edge 228 and the right side edge 230 are illustrated as being shorter compared to the left edge 28 and the right 30 depicted in FIG. 1. It is pointed out that the reference to the "right side" and the "left side" is based on viewing the training device 210 from the top side 220 rather than from the bottom side 222. An advantage of having a swept front, as illustrated in the training device 210, is greater ease of maneuverability or greater responsiveness. Less torque needs to be applied by the fingertip region and, as a result, it is easier to correct body position when using the training device 210.

The reference to a swept edge means that the swept portion (for example, edges 126', 126", 224', and 224" extend at an angle that is non-zero relative to the non-swept portion of the same edge (for example, edges 126 and 224). The swept angle can be any angle that provides the training device with the desired flow and control characteristics. Exemplary ranges for the swept angle include 2 degrees to 88 degrees, 5 degrees to 85 degrees, 10 degrees to 80 degrees, 20 degrees to 70 degrees, and 30 degrees to 60 degrees.

Figure 13:
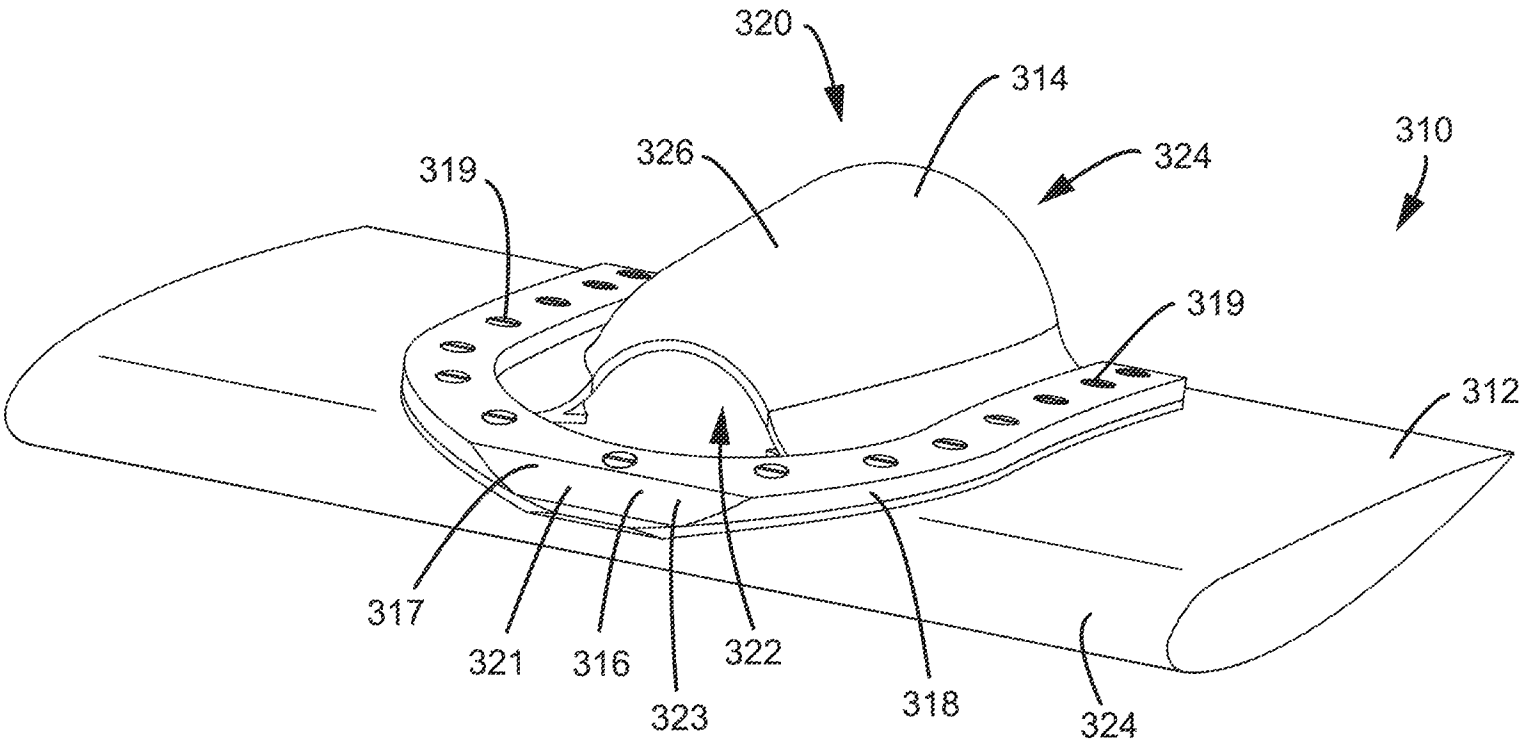
FIG. 13 is a top perspective view of an alternative embodiment of the swim training device according to the present disclosure.

Now referring to FIG. 13, an alternative training device 310 is depicted and can be characterized as having an open pocket 320 because of the opening 322 in the cover 326 in addition to the opening 324 for movement of the user's hands into and out of the hands pocket 314. A bracket assembly 316 including a bracket flange 318 and fasteners 319 fasten the cover 326 to the platform 312. As illustrated, the bracket flange 318 extends around the sides and front portion of the cover 326 so that the opening 322 is located above and behind the bracket forward portion 317. The bracket flange 318 is illustrated having a chamfer 321 on the forward edge 323 to provide desired flow properties, although the bracket flange 318 can be provided without the chamfer 321. While a single opening 322 is illustrated in addition to the opening 324, there can be additional openings, if desired. The opening 322, when placed in the forward portion of the hands pocket, may permit the use to push his or her fingers part way through the opening 322. This may have certain advantages. For example, moving the fingers forward may help with application of pressure on the leading edge 324 of the platform 312. In addition, squeezing the fingers into this opening may help press the fingers against the platform to provide added force keeping the user's hands on the platform 312. In addition, the training device 310 can include various other features identified herein in alternative embodiments including, for example, the shape of the platform 312. See for example, FIGS. 15A-16C.

Figure 14:
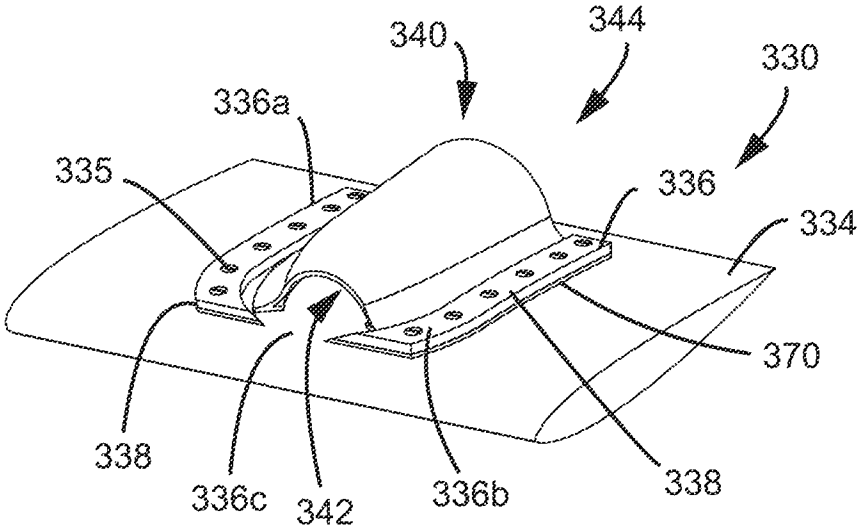
FIG. 14 is a top perspective view of an alternative embodiment of the swim training device according to the present disclosure.
Figure 14A:
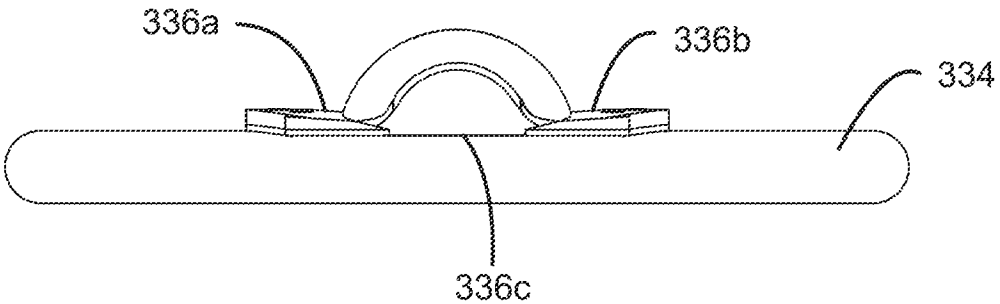
FIG. 14A is a front plan view of the swim training device of FIG. 14.
Figure 15A:
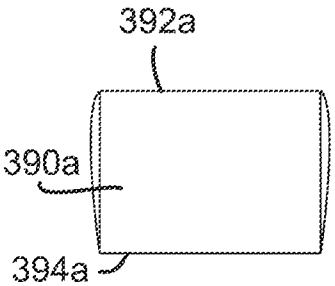
FIGS. 15A-H are exemplary shapes of the platform for use in the swim training device according to the present disclosure.
Figure 15B:
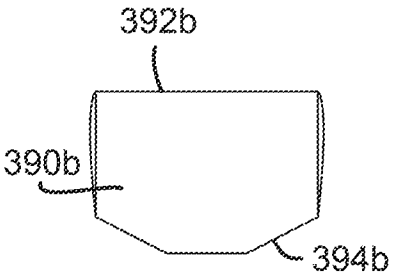
Figure 15C:
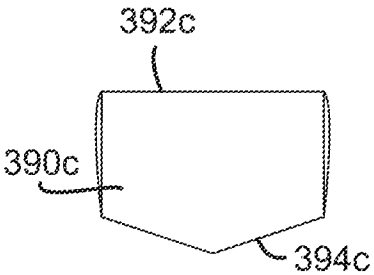
Figure 15D:
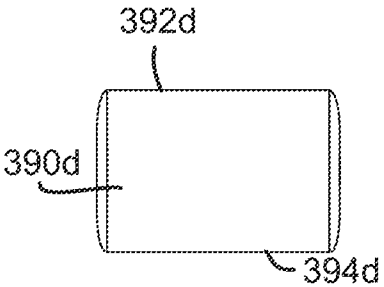
Figure 15E:
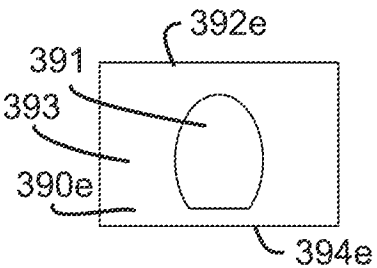
Figure 15F:
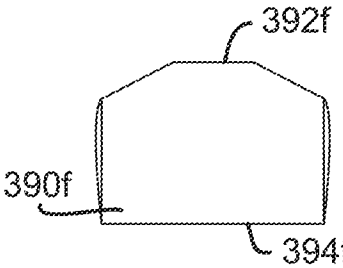
Figure 15G:
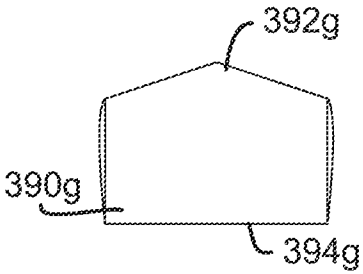
Figure 15H:
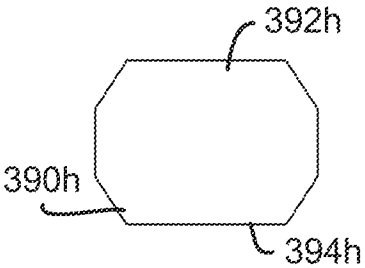

FIGS. 14 and 14A illustrate an alternative embodiment of the training device 330. The training device 330 can be characterized as having an open pocket 340 because of the opening 342 in addition to the opening 344. The training device 330 includes a platform 334 and a bracket assembly 336. The bracket assembly 336 includes a bracket flange 338 and fasteners 335. The bracket assembly 336 differs from the bracket assembly 316 because it is discontinuous and includes a right portion 336*a* and a left portion 336*b*, and the two portions are separated by a gap 336*c*. The gap 336*c* is located forward of the opening 342 and better permits a user's fingers to slide forward and potentially through the opening 342. The gap 336*c* permits the user to provide better feel and control of the platform 334

Alternative Platform Configurations

FIGS. 15A-H and 16A-C include various shapes and configurations of the platforms 390*a-h* and the platform 395*a-c*. These exemplary shapes and configurations can be used with various training devices according the to the principle of the present disclosure.

Figure 16A:
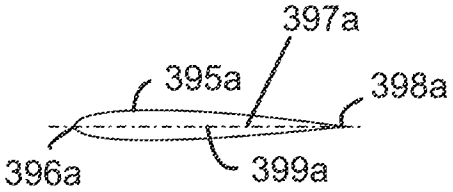
FIGS. 16A-C are exemplary shapes of the platform for use in the swim training device according to the present disclosure.
Figure 16B:
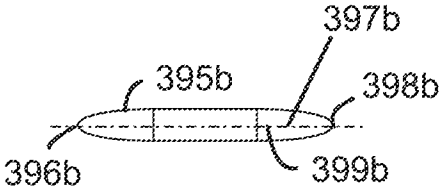
Figure 16C:
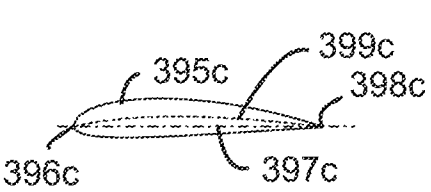

FIGS. 15A-H illustrates exemplary platform shapes for the platforms 390*a-h* from a top or bottom view extending from a leading edge 392*a-h* to a trailing edge 394*a-h*. As illustrated, the leading edge 392*f-h* may be swept back, and the trailing edge 394*b,c,h* may be swept forward thereby essentially shifting the center of the platform rearwardly or forwardly to provide advantage such as desired maneuverability. FIGS. 16A-C illustrates exemplary platform shapes of platforms 395A-C from a side view and extending from the leading edge 396*a-c* to the trailing edge 398*a-c*. As illustrated, an edge may be rounded such as shown in leading edges 396*a-c* and trailing edges 398*b*, and an edge may be a knife edge such as shown in trailing edges 398*a,c*. It should be appreciated that a leading edge can be provided as a knife edge, if desired. As illustrated, platform 390*a* corresponds with platform 395*a*.

It is noted that the various platforms may be symmetrical or asymmetrical from the leading edge to the trailing edge to provide desired advantage. Platforms 395*a-c* are illustrated with center lines 399*a-c* and cord lines 397*a-c*. Platforms 395*a* and 395*b* illustrate symmetrical platforms where the center lines 399*a* and 399*b* have no camber, and the center lines 399*a* and 399*b* are the same as the cord lines 397*a* and 397*b*. Platform 395*c* illustrates an asymmetrical platform where the center line 399*c* is cambered because it is different than the cord line 397*c*. In the platform 395*c*, the center line 399*c* is above the cord line 397*c*. This can be referred to as a positive camber. As an alternative, the center line can be provided below the cord line resulting in a negative camber. The shape can be adjusted to provide the desired performance. In the case of an asymmetric platform, such as platform 395*c*, the center line can be referred to as the camber line.

Either side of the platforms 395*a-c* can be used to hold the hands pocket when forming the training device according to the disclosure. In the case of an asymmetric platform 395*c* such as shown in FIG. 16C, the placement of the hands pocket on either side can provide a training device having a positive or a negative camber which can be used to advantage for training. Furthermore, a portion of a platform can be provided as flat to accommodate the hands pocket while retaining the desired amount of camber. Furthermore, a non-cambered platform can also have a flat portion to accommodate the hands pocket. An example of this is illustrated by the flat portion 391 on an otherwise curved surface 393 in FIG. 15E.

Modular Training Devices

Figure 17:
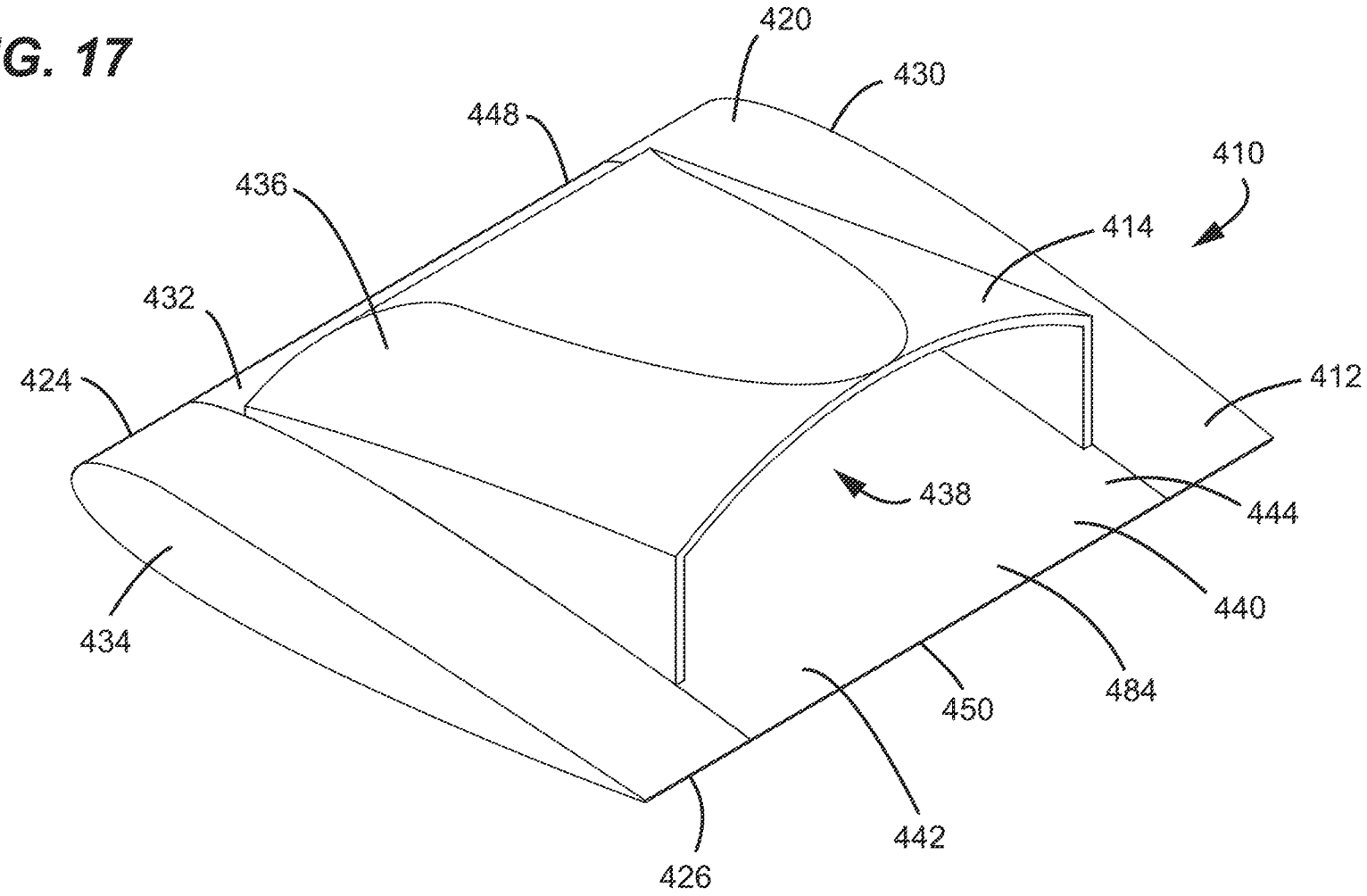
FIG. 17 is a top perspective view of an alternative embodiment of the swim training device according to the present disclosure.
Figure 17A:
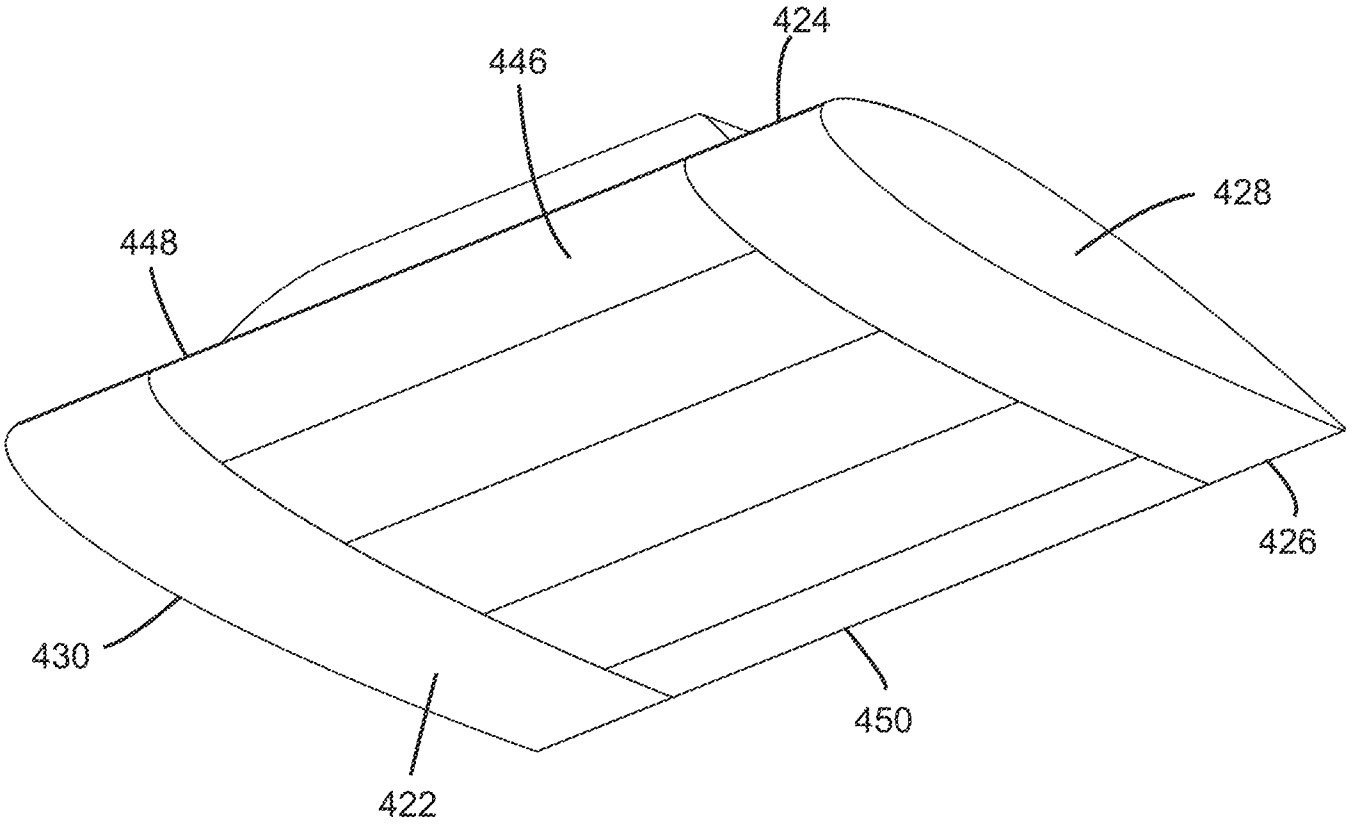
FIG. 17A is bottom perspective view of the swim training device of FIG. 17.

Now referring to FIGS. 17 and 17A, an alternative training device 410 is depicted having a modular platform 412 and a hands pocket 414. The modular platform 412 includes a right side section 430, and center section 432 supporting the hands pocket 414, and a left side section 434. The right side section 430 and the left side section 434 are separable from the center section 432 and permit interchange of different side sections to provide alternative geometries for the platform 412 while using the same center section 432. For example, the platform 412 can be adjusted to provide the exemplary shapes illustrated in FIG. 15. In addition, rather than being attached to the platform using mechanical fasteners, the hands pocket 414 is provided as part of a sleeve assembly 440 that fits over the platform 412. This design permits interchange of different sleeve assemblies having different size hands pockets to accommodate users having different size hands, and avoids the use of a bracket assembly described in other embodiments.

In general, the sleeve assembly 440 includes a cuff member 442 and a cover 436. The cuff member 442 includes a top cuff member 444 and a bottom cuff member 446. The top cuff member 444, when located on the platform 412, generally corresponds to the platform top side 420 and the bottom cuff member 446 generally corresponds to the platform bottom side 422. The top cuff member 444 and the bottom cuff member 446 attach at the cuff leading edge 448 and the cuff trailing edge 450. The cuff leading edge 448 corresponds to the platform leading edge 424, and the cuff trailing edge 450 corresponds to the platform trailing edge 426. Extending from the sleeve assembly 440 is the cover 436. The combination of the cover 436 and the top cuff member 444 forms the enclosure 438 for inserting therein the user's hands and for holding the user's hands in place.

Figure 18:
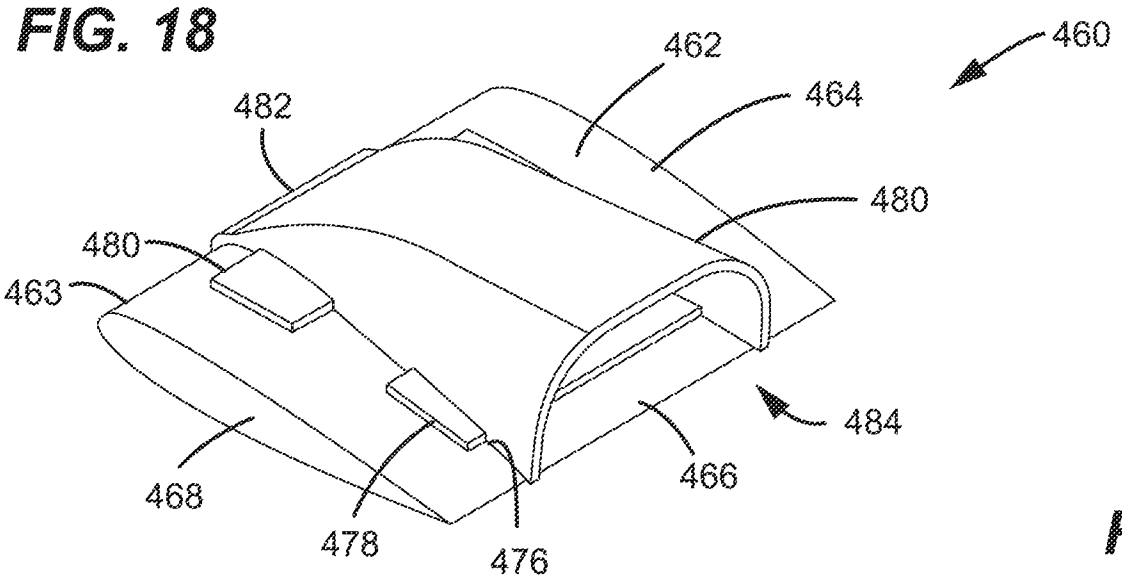
FIGS. 18-18B are illustrations of an alternative swim training device according to the present disclosure.
Figure 18A:
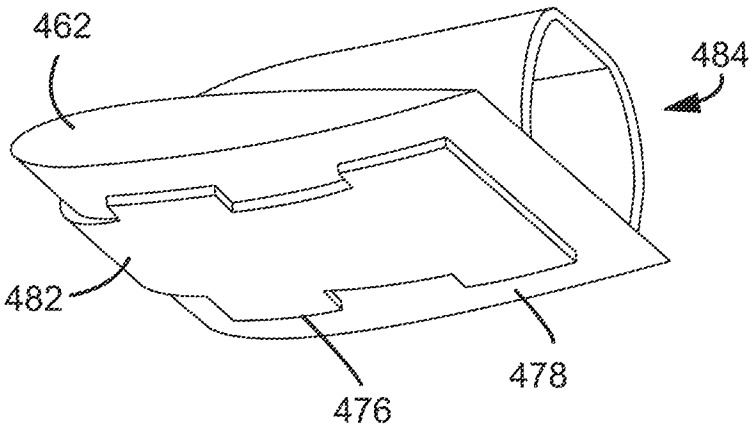
Figure 18B:
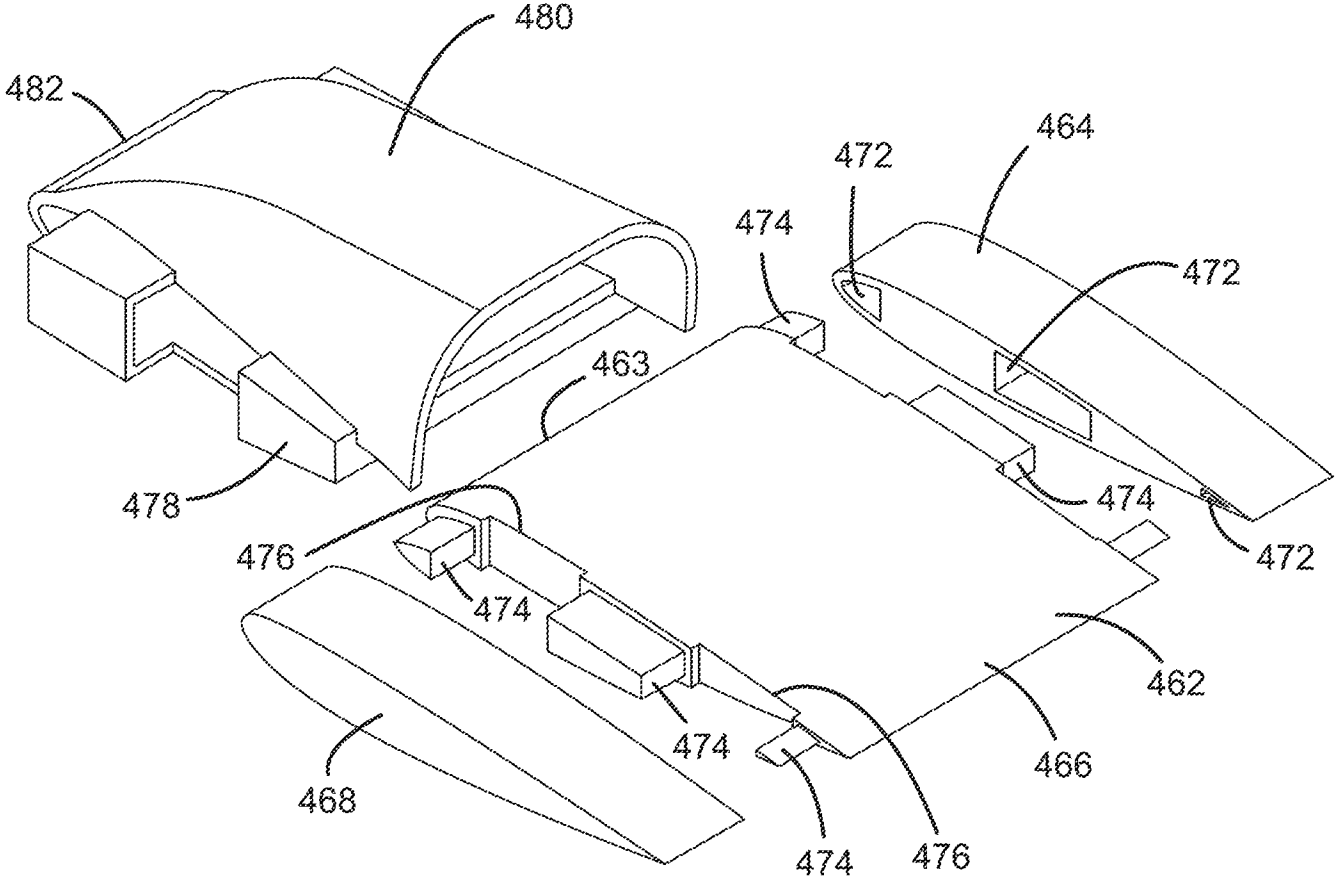

Now referring to FIGS. 18-18B, an alternative training device 460 is illustrated and shows an exploded platform 462. The platform 462 includes a right side section 464, and center section 466 supporting the hands pocket 484, and a left side section 468. The right side section 464 and the left side section 468 are shown in FIG. 18B separated from the center section 466. As illustrated, the right side section 464 and the left side section 468 include recesses 472, and the center section 466 includes projections 474 that engage the recesses 472. In general, the projections 474 can be held in place in the recesses 472 by an interference fit or any other technique that holds them together. Furthermore, the projections 474 can be located on the side sections and the recesses 472 can be located on the center section, and alternatives can be provided.

When the right and left side sections 464 and 468 are attached to the center section 466, gaps 476 are provided and straps 478 of the sleeve assembly 480 extend therethrough. As illustrated, the sleeve assembly 480 includes straps 478 that extend through the gaps 476 to thereby hold the sleeve assembly in place on the platform 462. The sleeve assembly 480 additionally includes a forward strap 482 that extends around the leading edge 463 of the platform 462. The sleeve assembly 480 additionally includes a hands pocket 484 for holding the user's hands to the platform 462.

Figure 19:
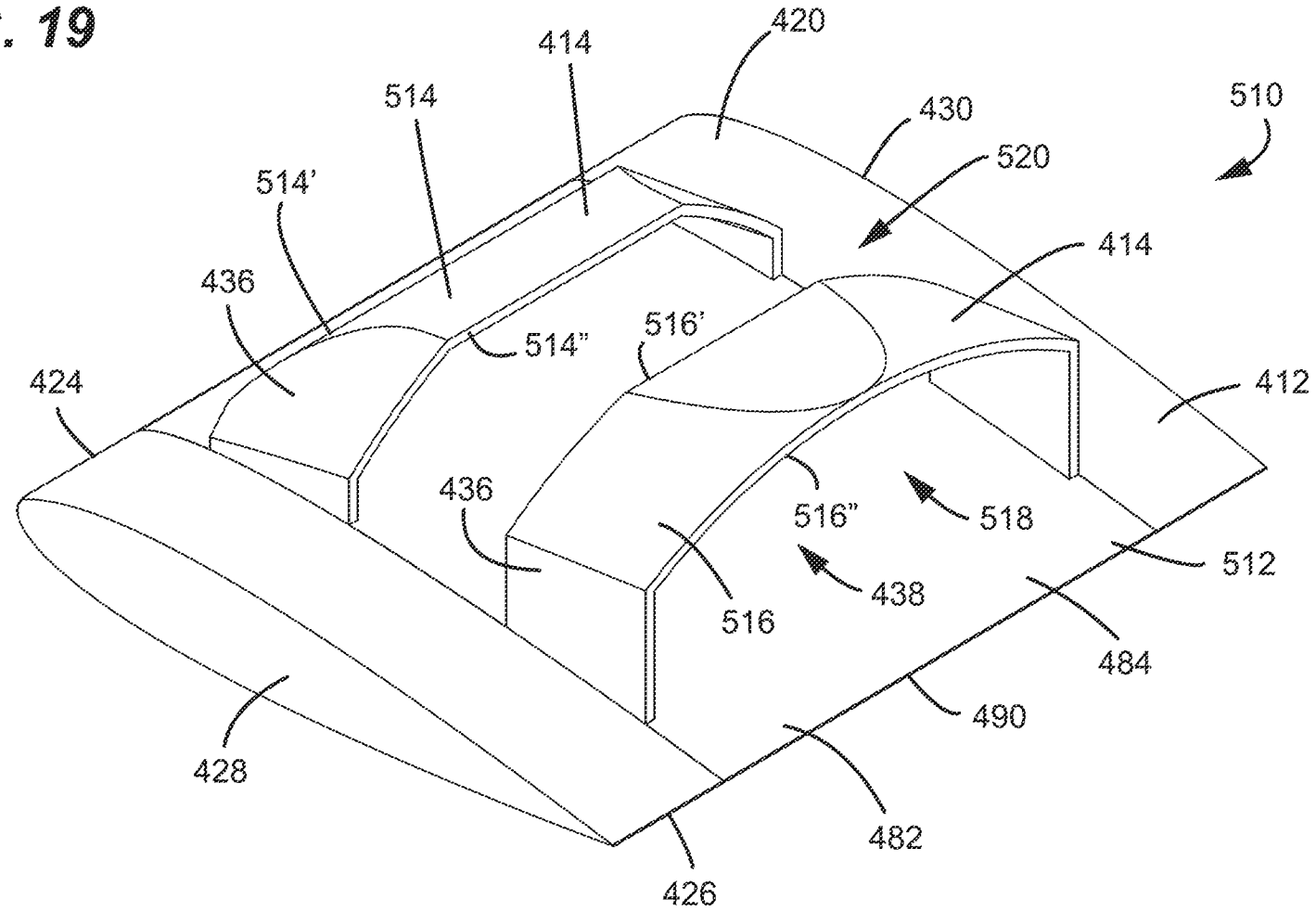
FIG. 19 is a top perspective view of an alternative embodiment of the swim training device according to the present disclosure.
Figure 19A:
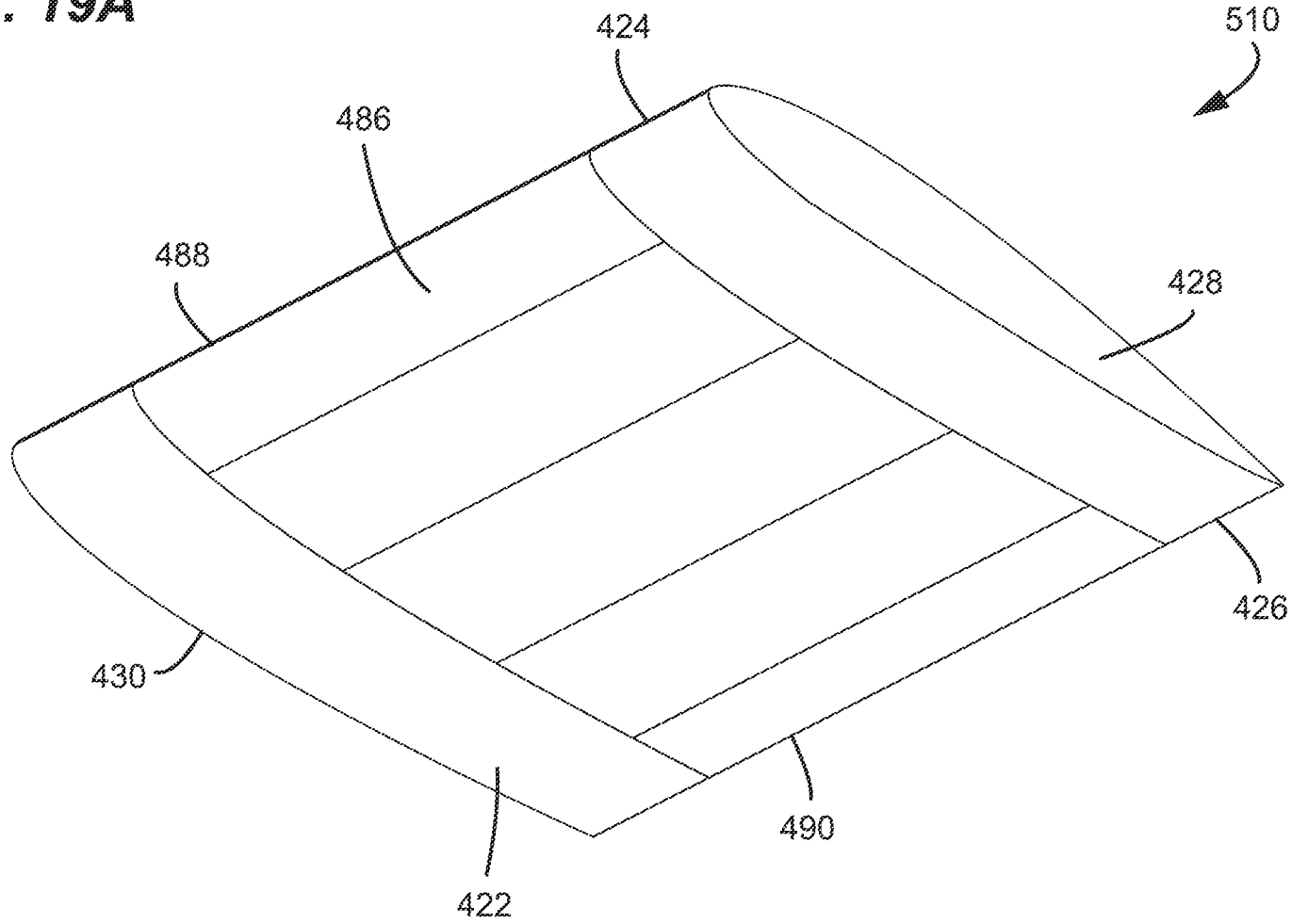
FIG. 19A is bottom perspective view of the swim training device of FIG. 19.

Now referring to FIGS. 19 and 19A, an alternative training device 510 is depicted. The training device 510 is similar to the training device 410, and includes the same platform 412, but the sleeve assembly 512 is different from the sleeve assembly 480. Similar to the sleeve assembly 480, the sleeve assembly 512 includes a cuff member 482 and a cover 436. The cuff member 482 includes a top cuff member 484 and a bottom cuff member 486. The top cuff member 484, when located on the platform 412, generally corresponds to the platform top side 420 and the bottom cuff member 486 generally corresponds to the platform bottom side 422. The top cuff member 484 and the bottom cuff member 486 attach at the cuff leading edge 488 and the cuff trailing edge 490. The cuff leading edge 488 corresponds to the platform leading edge 424, and the cuff trailing edge 490 corresponds to the platform trailing edge 426. Extending from the cuff member 482 is the cover 436. The combination of the cover 436 and the top cuff member 484 forms the enclosure 438 for inserting therein of the user's hands and for holding the user's hands in place. The cover 436, however, includes a first cover strap 514 and a second cover strap 516. Any number of straps can be provided, and they can essentially be considered as bands that hold the user's hands to the platform 420. It should be noted that the pocket can be referred to as an open pocket 518 in view of the opening 520 provided between the first cover strap 514 and the second cover strap 516.

The cover straps 514 and 516 are exemplified in an arrangement where they are separate from each other and cover different portions of the user's hands when inserted into the hands pocket or enclosure 438. The cover strap 516 is considered open on both sides meaning that the user's hands can extend through both the forward edge 516' and trailing edge 516" of the cover strap 516. The cover strap 514 can be considered open on the trailing edge 514" and can be provided as either open or closed on the leading edge 514' depending on whether it is desired to have the forward portion of the hands pocket 438 closed or open. The illustrated cover 514 can be considered open because the leading edge 514' is open, and allows finger tips to extend therethrough, but could be provided as closed similar to the cover 436.

The alternative training device 510 is advantageous because it can provide a strap (for example, the first cover strap 514) over the user's fingertips to immobilize the user's fingertips against the platform 420, and also provide a strap (for example, the second cover strap 516) over the user' hands opposite the palms to help hold the user's hands to the platform 420. Furthermore, the training device can be provided where the cover straps 514 and 516 do not necessarily extend from a cuff member assembly but instead wrap the center section in a manner similar to that described in the training device 460.

Figure 20:
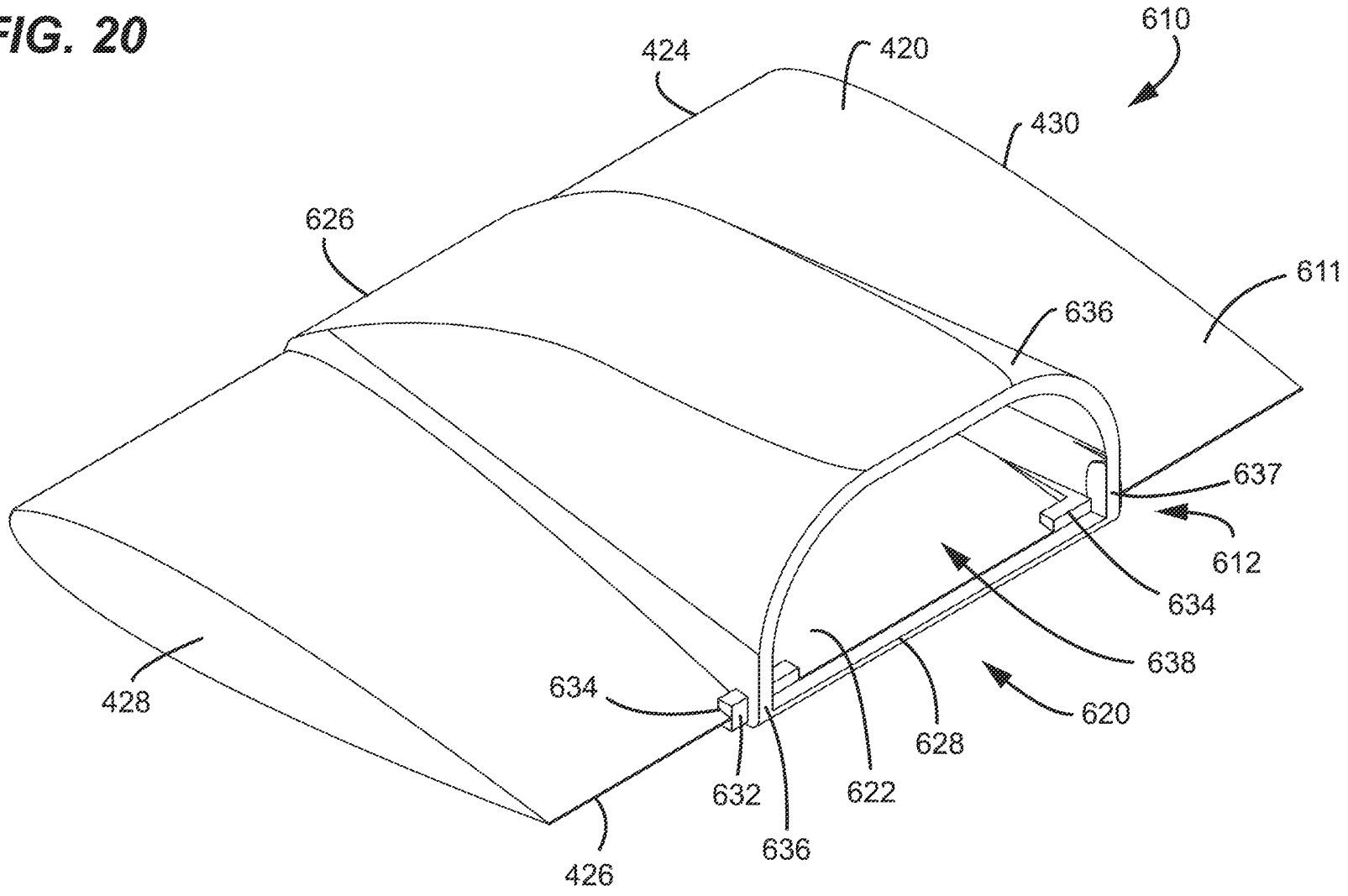
FIG. 20 is a top perspective view of an alternative embodiment of the swim training device according to the present disclosure.
Figure 20A:
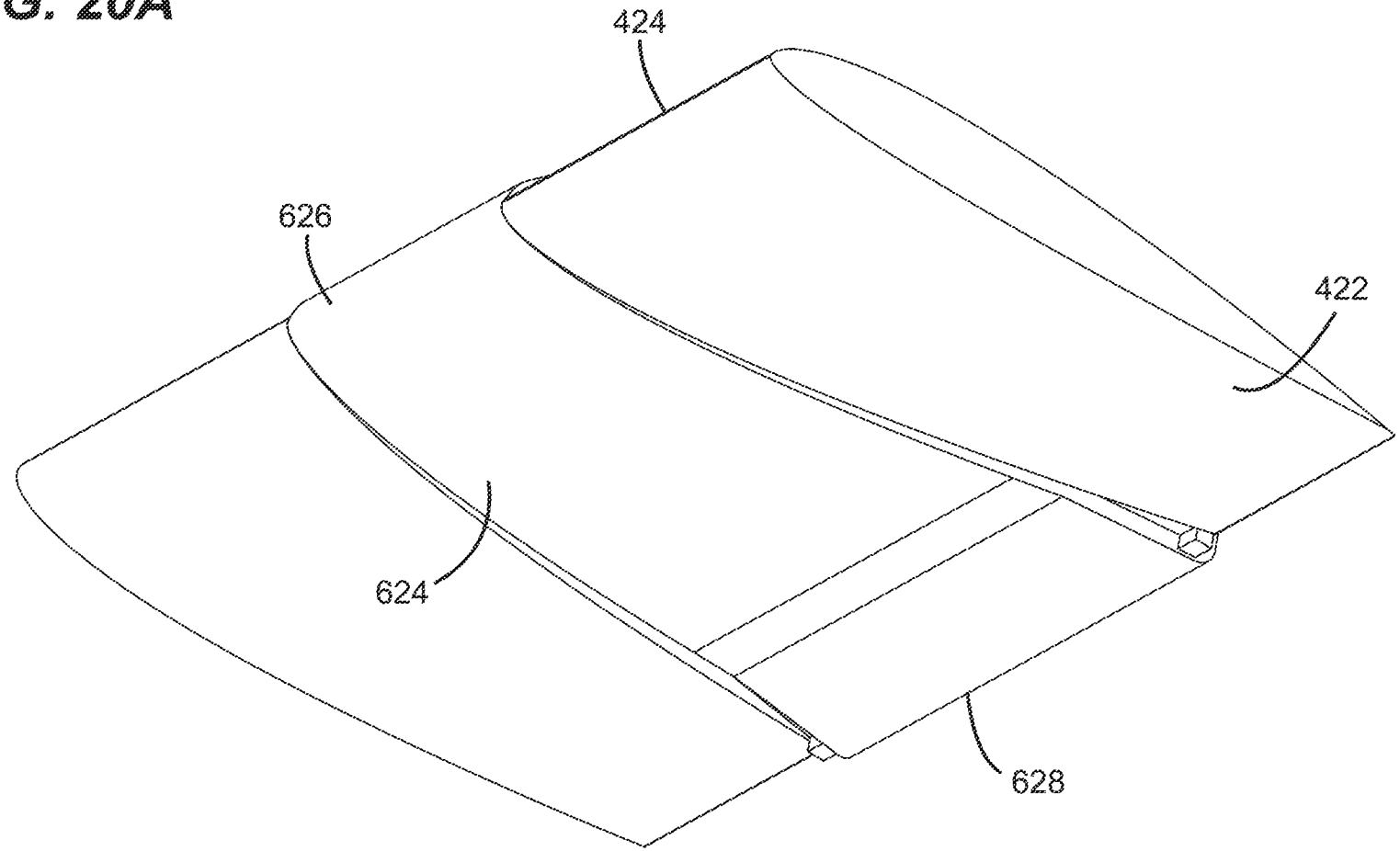
FIG. 20A is bottom perspective view of the swim training device of FIG. 20.

Now referring to FIGS. 20 and 20A, an alternative training device is depicted at reference number 610. The training device 610 includes a platform 611 and a sleeve assembly 612. The platform 611 is illustrated as a non-modular platform, but the design can be used with a modular platform as described previously, if desired. The sleeve assembly 612 includes a cuff member 620 and cover 636. The cuff member 620 includes a top cuff member 622 and a bottom cuff member 624. The top cuff member 622, when located on the platform 611, generally corresponds to the platform top side 420 and the bottom cuff member 624 generally corresponds to the platform bottom side 422. The top cuff member 622 and the bottom cuff member 624 attach at the cuff leading edge 626 and the cuff trailing edge 628. The cuff leading edge 626 corresponds to the platform leading edge 424, and the cuff trailing edge 628 corresponds to the platform trailing edge 426. Extending from the cuff member 620 is the cover 636. The cover 636 forms the enclosure 638 for inserting therein of the user's hands and for holding the user's hands in place.

The cuff member 622 includes a cuff catch 632 having groove or recess 634 for engaging the platform trailing edge 426. The cuff catch 632 helps located and hold the cuff member 622 onto the platform 611. The cuff catch 632 can be provided extending from the cuff left side 636 to the cuff right side 637, but is shown as noncontinuous from the cuff left side 636 to the cuff right side 637.

Additional Alternative Training Devices

Figure 21:
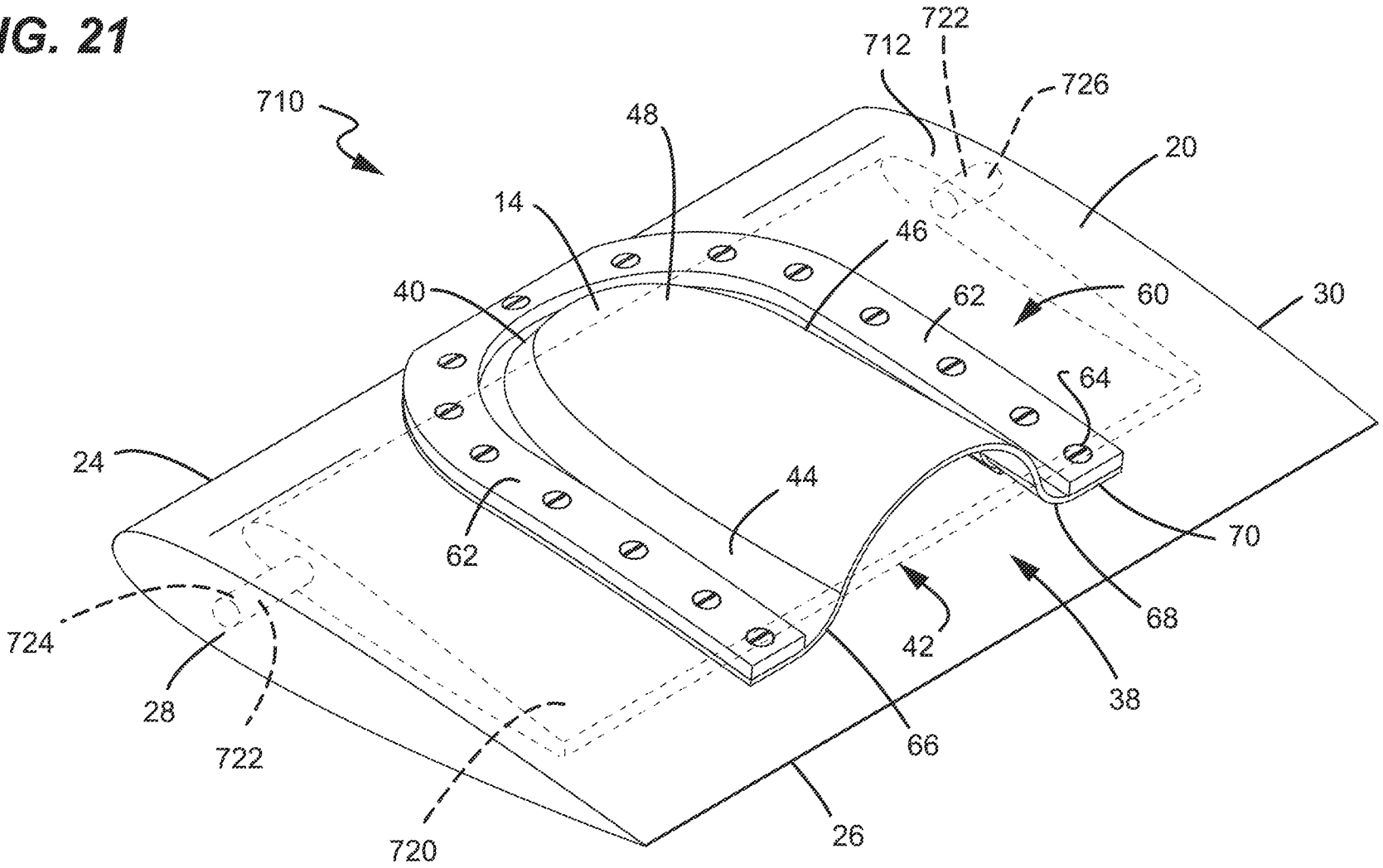
FIGS. 21-21A are perspective and top views of an alternative swim training device having therein a chamber for effecting buoyancy of the training device according to the present disclosure.
Figure 21A:
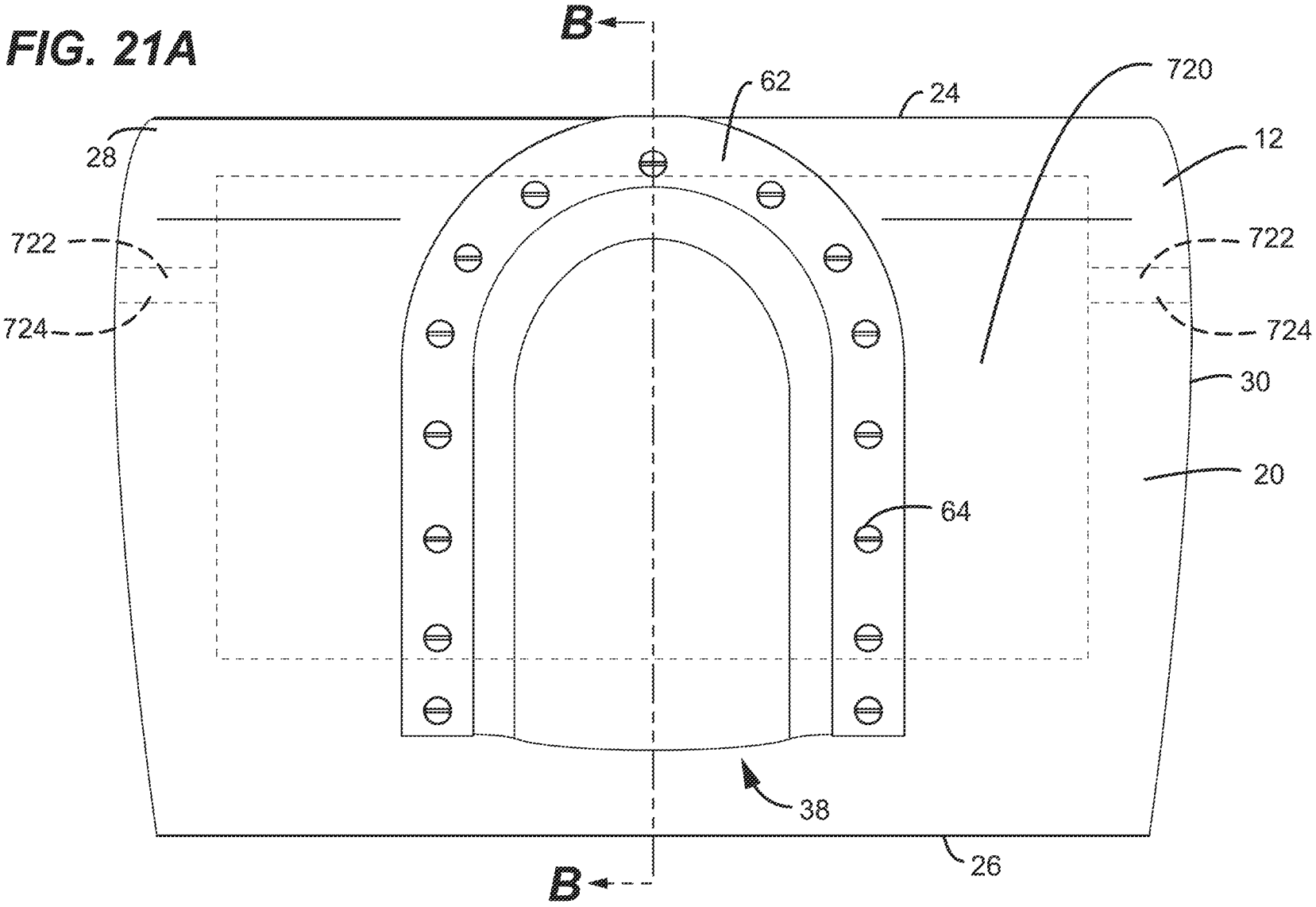
Figure 21B:
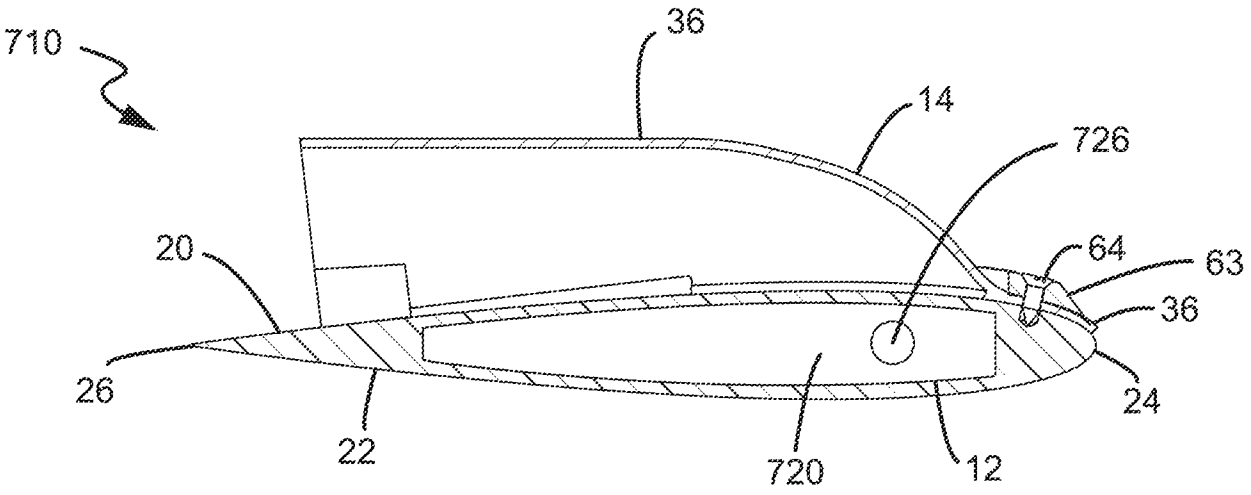
FIG. 21B is a sectional view of the swim training device shown in FIG. 21A taken along lines B-B.

Now referring to FIGS. 21-21B, an alternative training device is depicted at reference number 710. The particular training device 710 is illustrated based on the embodiment of the training device 10 depicted in FIGS. 1-8. It should be appreciated that the features of the training device 710 can be utilized in the various alternative training devices described herein, as appropriate. The training device 710 includes a platform 712 and is illustrated having a chamber 720 therein that can be filled with water, air, or a combination thereof to effect buoyancy. The chamber 720 can be considered a hollow chamber 722 relative to the remainder of the platform 712. The size and location of the chamber 720 within the platform can be selected depending on whether the chamber 720 is desired to be located more toward the leading edge 24 or more toward the trailing edge 26 of the platform 712 and can be located closer to or further away from the left edge 28 and the right edge 30. One would understand that the design and placement or location of the chamber 720 within the platform 712 will effect the positive or negative buoyancy of the platform 712 both forwardly and rearwardly, and the stability side to side.

The chamber 720 can be ported with an opening 722 that permits filling and emptying of the chamber 720. Preferably, the opening 722 includes a left side opening 724 and a right side opening 726. Additional openings can be provided and can be located at other locations including the platform top side 20, the platform bottom side 22, or in any other location that provides for convenience of filling and emptying the chamber 720. An advantage of porting on opposite sides of the platform is that this arrangement permits flow of water out of the chamber 720 through one port while venting through the opposite port. Plugs can be used to stopper the openings 722 to thereby seal the chamber 720. Alternatively, various valve arrangements can be provided to control flow of water and/or air into and out of the chamber 720. When provided with a positive buoyancy by, for example, filling the chamber 720 mostly with air, the training device 710 can be used like a traditional kickboard that floats on the surface of the water. When provided with a neutral buoyancy by, for example, filling the chamber 720 mostly with water, the training device 710 will tend to neither float to the surface or sink to the bottom of a pool of water, and can be used to advantage for training the underwater dolphin kick.

It should be appreciated that plugs can be used that fill the openings 722 and can be removed therefrom to permit water and/or air to flow therethrough and then can be reinserted. Various valves, such as, spring valves can be used that, when depressed, open, and return to a closed position. Alternatively, non-spring type valves can be used that are adjusted to open and close and thereby permit flow of water and/or air into or from the chamber 720.

While the chamber 720 is illustrated in the context of a non-modular training device, the chamber 720 can also be used in a modular training device. For example, the chamber 720 can be located in the center section (for example, center section 432 in FIG. 17) and the openings 724 and 726 can be provided extending through the side sections (for example, side sections 430 and 434). In addition, the side sections can include the plugs that close the openings thereby avoiding the need for valves.

Figure 22:
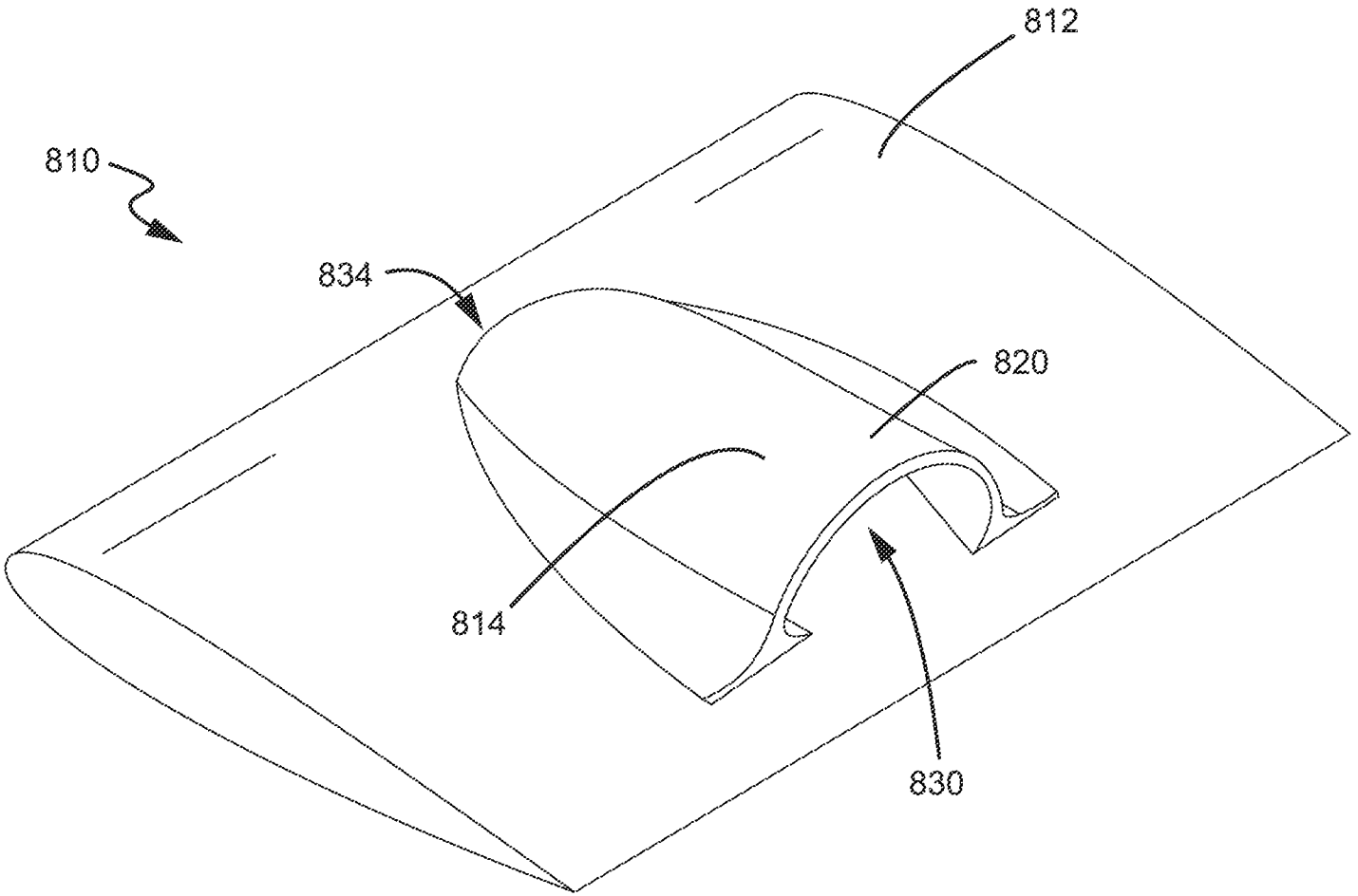
FIGS. 22-22A are perspective, trailing edge, and sectional views of an alternative swim training device according to the present disclosure.
Figure 22A:
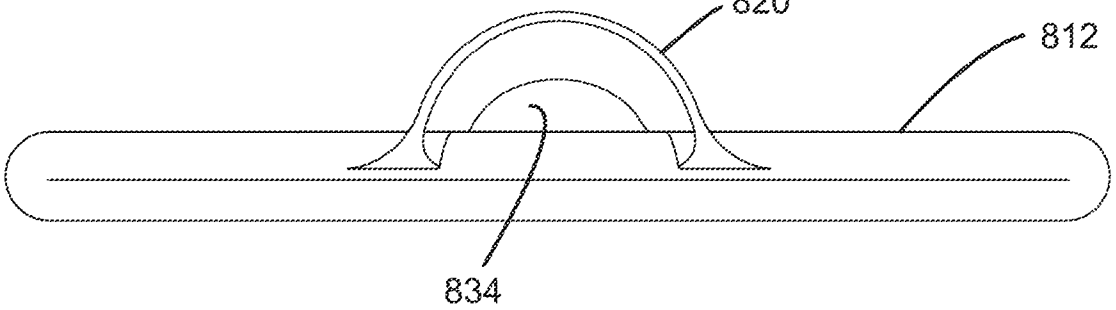

Referring to FIGS. 22-22A, an alternative training device 810 is illustrated having a platform 812 and cover a hands pocket 814. The hands pocket 814 is formed by the opening between the cover 820 and the platform 812, and can be referred to as an open pocket because of the presence of both the opening 830 for sliding the user's hands into and out of the hands pocket 814, and the forward opening 834 located at the forward or leading portion of the hands pocket 814.

The training device 810 is illustrated as a singular or integral unit where the hands pocket 814 is formed integral with the platform 812. That is, the cover 820 is part of the platform 812, and can be formed from the same material. The entire training device 810 can be formed by, for example, 3-D printing.

While the training device is described in the context of the user placing both hands inside a pocket, it should be appreciated that the device includes an embodiment where the hands are place in subpockets, and the subpockets can be considered the hands pocket even if the subpockets are a distance from each other. Furthermore, although the hands pocket is preferably configured so that the user's hands are located on top of each other, it should be appreciated that the hands pocket can be arranged so that the user's hands are located in a non-stacked arrangement.

Operation of the Training Device

The operation of the training device of the present disclosure can be described in the context of the training device 10. It should be understood, however, that the described alternatives of the training device can also be used in the same manner.

The user of the training device 10 places his or her hands in the hands pocket 14 so that the hands are in a hand-over-hand arrangement with the palms facing toward the platform top side 20. The user pushes off from the wall (using his or her legs) with the arms extended above and behind the head, under the surface of the water (not on the surface) in a streamline position. The training device 10 restricts movement of the hands, arms and shoulders in a vertical direction (or in a direction perpendicular to the plane formed by the user's hands against the platform top side 20. This assumes that the user pushes off from the wall with his or her front side facing the pool bottom and his or her back side facing the water surface. Of course, the user can push off from the wall at any angle and the principles still apply. The training device 10 restricts hand and arm movement in the vertical plane. In view of the restricted ability of the user to move his or her hands, arms, and shoulders, the training device 10 helps isolate the swimmer's movements so that the swimmer quickly learns how to press upwardly and downwardly with his or her hands to initiate a corresponding movement in his or her chest to thereby propagate a wave motion through the swimmer's body. It is the very small motion in the hand and forearms and growth of the wave motion through the shoulders and chest that is difficult to learn effectively in performing the underwater dolphin kick. The underwater dolphin kick can almost accurately be described as a wave motion that begins with a very small movement in the hands and forearms, and then grows sequentially through the shoulder, chest, torso, hips, waist, thighs, lower leg, and feet. As the "wave" travels through the body, larger and stronger muscle groups within the body are recruited thereby strengthening the kick action and providing increase propulsion while maintaining a very streamlined position in the arm and shoulders to cut through the water with minimal resistance. Thus, the training device helps the user develop the streamlined technique in conjunction with the coordination to master this difficult action. Continued training with the training device 10 helps strengthen the kick, and increases speed and develops the stamina to perform this motion after pushing off the wall throughout a race.

Numerous platform sizes can be used to learn and train the technique. The training device can have any desired buoyancy but preferably, the training device has a buoyancy that is neutral or close to neutral to water when teaching and training the underwater dolphin kick. In general, the buoyancy can be considered to correspond to density, and the density of water is about 1 g/cc. Accordingly, a preferred density of the training device is about 0.6 g/cc to about 1.4 g/cc, more preferably about 0.8 g/cc to about 1.2 g/cc, and more preferably about 0.9 g/cc to about 1.1 g/cc. It should be appreciated that the density can be adjusted in several ways by selecting the materials for the platform the cover and by also introducing cells or air pockets into the platform or cover to decrease density.

With the training device in a neutral fluid dynamic position (horizontal relative to the forward motion), the training device enables the swimmer to pull up and press down with the hands but generate very limited vertical movement in the hands. This teaches the swimmer to initiate an up and down vertical plane movement from the chest. Other methods of teaching this technique are difficult. Existing equipment like kickboards and fins teach the initiation of the kick in the waist and thighs rather than in the chest, and only exercise half the motion since they are used on the surface of the water. Without being under the surface of the water, it is very difficult to learn the correct dolphin kick motion. Vertical hand movement creates forward resistance and slow the swimmer down. Creating a growing wave motion through the body initiated by deflecting the chest up and down with no motion in the hands is not a natural body movement. The training device enables the swimmer to get a feel and develop muscle memory for this unnatural deflection of the chest up and down to initiate the kick.

Exemplary Materials of the Training Device:

The platform component of the training device can be provided by any material that can provide a streamlined profile with varying surface areas. Exemplary materials can include cast polyurethane. Preferably, the platform can be made from an extruded or injection molded thermoplastic polymeric material.

The hands pocket provides a location where the user's hands tightly attach to the platform in a hand-over-hand, streamlined arrangement. The hands pocket can be provided as a hand hold sleeve. This is a flexible/rubber/silicone like material that is in direct contact with the hands and is sized so that when hands are placed on top of each other, they slip tightly into a sleeve made of this material that is fastened to the platform with the horseshoe and fasteners described below. An exemplary material for this is:

a. Shore Hardness: 30A
b. Tensile Strength: 1000+ psi
c. Elongation %: 1000%
d. Tear Strength: 110 pli The horseshoe-shaped rigid solid plastic piece with screw holes clamps the flexible hand-hold sleeve to the platform. The leading edge is closed, the trailing edge is open and is where the hands slip underneath the hand-hold sleeve. The dimensions of the horseshoe vary for the hand size of the swimmer. The fasteners can be screws that go through the screw holes in the horseshoe and into the platform to clamp the hand-hold sleeve to the platform.

The above specification provides a complete description of the manufacture and use of the composition of the invention. Since many embodiments of the invention can be made without departing from the spirit and scope of the invention, the invention resides in the claims hereinafter appended.

What is claimed is:

1. A swim training device comprising:
(a) a platform having a top side and a bottom side, and extending longitudinally from a leading edge to a trailing edge and extending laterally from a left edge to a right edge; and
(b) a hands pocket located on the top side of the platform and including a hands entry opening facing toward the trailing edge of the platform, wherein:
(i) the hands pocket is configured to receive a user's two hands through the hands entry opening so that the user's two hands are located in the hands pocket arranged in a generally extended configuration;
(ii) the hands pocket is configured to hold the user's two hands in place in the generally extended configuration against the top side of the platform;
(iii) the hands pocket is configured to resist longitudinal and lateral movement of the user's two hands relative to the platform when the user's two hands are located within the hands pocket;
(iv) the hands pocket being formed from a material separate from the platform and having a right edge and a left edge; and
(v) the right edge and the left edge of the hands pocket are each attached to the top side of the platform such that the right edge of the hands pocket is spaced away from right edge of the platform and the left edge of the hands pocket is spaced away from the left edge of the platform.

2. A swim training device according to claim 1 wherein:
(a) the platform has a buoyancy that is neutral with water.

3. A swim training device according to claim 1 wherein:
(a) the platform has a density of about 0.6 g/cc to about 1.4 g/cc.

4. A swim training device according to claim 1 wherein:
(a) the hands pocket is formed by a cover attached to the top side of the platform.

5. A swim training device according to claim 4, further comprising:
(a) a bracket assembly constructed to attach the cover to the top side of the platform.

6. A swim training device according to claim 5 wherein:
(a) the bracket assembly comprises a bracket flange that extends in a shape forming an enclosure constructed to fit the user's two hands.

7. A swim training device according to claim 4 wherein:
(a) the hands pocket is formed from a sleeve assembly comprising a cuff member that fits over the platform and extends around the leading edge and the trailing edge of the platform, and the cover extends from the cuff member.

8. A swim training device according to claim 1 wherein:
(a) the hands pocket is closed except at the hands entry opening.

9. A swim training device according to claim 1 wherein:
(a) the hands pocket includes an opening at a leading portion of the hands pocket.

10. A swim training device according to claim 1 wherein:
(a) the platform has a maximum width of about 8 inches to about 24 inches from the left edge to the right edge.

11. A swim training device according to claim 1 wherein:
(a) the platform has a maximum length from the forward edge to the trailing edge of about 5 inches to about 18 inches.

12. A swim training device according to claim 1 wherein:
(a) at least one of the forward edge or the trailing edge includes a swept edge where at least a portion of the forward edge or the trailing edge extends at a non zero angle to a remaining portion of the forward edge or the trailing edge.

13. A swim training device according to claim 1 wherein:
(a) the platform is a modular construction having a right side portion, a left side portion, and a center portion, and the right side portion and the left side portion are constructed to connect and disconnect from the center portion.

14. A swim training device according to claim 1 wherein:
(a) the platform includes a chamber therein constructed to be filled with air, water, or a combination of air and water, and sealed, wherein the chamber effects the buoyancy of the swim training device.

15. A swim training device according to claim 1 wherein:
(a) the platform comprises a center line extending from the leading edge to the trailing edge, and a cord line extending from the leading edge to the trailing edge, wherein the center line and the cord line are the same.

16. A swim training device according to claim 1 wherein:
(a) the platform comprises a center line extending from the leading edge to the trailing edge, and a cord line extending from the leading edge to the trailing edge, wherein the center line and the cord line are different.

17. A swim training device according to claim 1 wherein:
(a) the hands pocket is configured to receive the user's two hands in a hand-over- hand arrangement.

18. A swim training device comprising:
(a) a platform having a top side and a bottom side, and extending longitudinally from a leading edge to a trailing edge and extending laterally from a left edge to a right edge, and a chamber therein constructed to be filled with air, water, or a combination of air and water; and
(b) a hands pocket located on the top side of the platform and including a hands entry opening facing toward the trailing edge of the platform, wherein:
(i) the hands pocket is configured to receive a user's two hands through the hands entry opening so that the user's two hands are located in the hands pocket and arranged in a generally extended configuration;
(ii) the hands pocket is configured to hold the user's two hands in place in the generally extended configuration against the top side of the platform;
(iii) the hands pocket is configured to resist longitudinal and lateral movement of the user's two hands relative to the platform, and movement away from the platform, when the user's two hands are located within the hands pocket during use of the swim training device;
(iv) the hands pocket being formed from a material separate from the platform and having a right edge and a left edge; and
(v) the right edge and the left edge of the hands pocket are each attached to the top side of the platform such that the right edge of the hands pocket is spaced away from right edge of the platform and the left edge of the hands pocket is spaced away from the left edge of the platform.

19. A swim training device according to claim 18 wherein:
(a) the platform has a buoyancy that is neutral with water.

20. A swim training device according to claim 18 wherein:
(a) the platform has a density of about 0.6 g/cc to about 1.4 g/cc.

21. A swim training device according to claim 18 wherein:
(a) the hands pocket is formed by a cover attached to the top side of the platform.

22. A swim training device according to claim 21, further comprising:
(a) a bracket assembly constructed to attach the cover to the top side of the platform.

23. A swim training device according to claim 22 wherein:
(a) the bracket assembly comprises a bracket flange that extends in a shape forming an enclosure constructed to fit the user's two hands.

24. A swim training device according to claim 21 wherein:
(a) the hands pocket is formed from a sleeve assembly comprising a cuff member that fits over the platform and extends around the leading edge and the trailing edge of the platform, and the cover extends from the cuff member.

25. A swim training device according to claim 18 wherein:
(a) the hands pocket is closed except at the hands entry opening.

26. A swim training device according to claim 18 wherein:
(a) the hands pocket includes an opening at a leading portion of the hands pocket.

27. A swim training device according to claim 18 wherein:
(a) the platform has a maximum width of about 8 inches to about 24 inches from the left edge to the right edge.

28. A swim training device according to claim 18 wherein:
(a) the platform has a maximum length from the forward edge to the trailing edge of about 5 inches to about 18 inches.

29. A swim training device according to claim 18 wherein:
(a) at least one of the forward edge or the trailing edge includes a swept edge where at least a portion of the forward edge or the trailing edge extends at a non zero angle to a remaining portion of the forward edge or the trailing edge.

30. A swim training device according to claim 18 wherein:
(a) the platform is a modular construction having right and left side portions that are constructed to disconnect from a center portion.

31. A swim training device according to claim 18 wherein:
(a) the hands pocket is configured to receive the user's two hands in a hand-over- hand arrangement.

* * * * *